US008398065B2

(12) United States Patent
Obuchi et al.

(10) Patent No.: US 8,398,065 B2
(45) Date of Patent: Mar. 19, 2013

(54) SHEET PUNCHING DEVICE AND IMAGE FORMING APPARATUS HAVING SHEET PUNCHING DEVICE

(75) Inventors: Yusuke Obuchi, Abiko (JP); Kenichi Hayashi, Abiko (JP); Kiyoshi Watanabe, Matsudo (JP); Rikiya Takemasa, Toride (JP); Akito Sekigawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 337 days.

(21) Appl. No.: 12/815,971

(22) Filed: Jun. 15, 2010

(65) Prior Publication Data

US 2010/0329755 A1 Dec. 30, 2010

(30) Foreign Application Priority Data

Jun. 26, 2009 (JP) ..... 2009-152622

(51) Int. Cl.
*B26F 1/14* (2006.01)

(52) U.S. Cl. ..... 270/58.07

(58) Field of Classification Search ..... 270/58.07; 83/111, 618, 627, 684, 686, 687, 688, 691
See application file for complete search history.

(56) References Cited

U.S. PATENT DOCUMENTS

| | | | | |
|---|---|---|---|---|
| 4,791,843 | A * | 12/1988 | Herrington et al. | 347/171 |
| 6,120,015 | A * | 9/2000 | Albright et al. | 270/58.07 |
| 6,186,720 | B1 * | 2/2001 | Chiang | 412/16 |
| 7,143,675 | B2 * | 12/2006 | Chiang | 83/193 |
| 7,735,402 | B2 * | 6/2010 | Tsuji et al. | 83/166 |

FOREIGN PATENT DOCUMENTS

| | | | |
|---|---|---|---|
| JP | 11-245198 | A | 9/1999 |
| JP | 2006-231449 | A | 9/2006 |
| JP | 2006-272496 | A | 10/2006 |
| JP | 2006-281323 | A | 10/2006 |

* cited by examiner

*Primary Examiner* — Leslie A Nicholson, III
(74) *Attorney, Agent, or Firm* — Canon USA, Inc., I.P. Division

(57) ABSTRACT

A sheet punching device includes a first blade, a first die into which the first blade is fitted from a first surface of a sheet to form a punch hole in the sheet, a second blade, and a second die into which the second blade is fitted. The second blade is inserted into the punch hole formed by the first blade from a second surface of the sheet and fitted into the second die.

16 Claims, 24 Drawing Sheets

SHEET PUNCHING DEVICE AND IMAGE FORMING APPARATUS HAVING SHEET PUNCHING DEVICE

BACKGROUND OF THE INVENTION

1. Field of the Invention

The present invention relates to a sheet punching device and an image forming apparatus having the sheet punching device for forming a punch hole in a sheet.

2. Description of the Related Art

In recent years, some image forming apparatuses such as cameras and laser beam printers have a sheet punching device, which punches a punch hole in a sheet on which an image is formed. A user files and uses the sheet in which the punch hole is formed by the sheet punching device.

In the sheet punching device, there is a case in which a burr is generated in the punch hole depending on a kind of sheet, a use environment such as temperature and humidity, and a time-dependent change such as abrasion. If the burr is generated in the punch hole of the sheet, when stacking the punched sheets to form a sheet bundle in a post process, burr portions of the stacked sheets overlap.

As a result, a stacking state of the sheets may be in disarray, or the burr of a next stacked sheet may be caught on the sheet bundle to cause misalignment of the stacked sheets. Thus, it causes a problem in post-processing the punched sheets.

For this reason, several punching devices, which do not generate the burr in the punched punch hole as little as possible, have been suggested. For example, a front end portion of a punch may have a sharpened configuration to prevent the burr from being generated when punching is performed by the punch as discussed in Japanese Patent Application Laid-Open No. 11-245198.

As a punching device, which punches a hole in a hard material to be processed other than a paper without generating the burr, there is discussed a device having the following configuration in Japanese Patent Application Laid-Open No. 2006-272496. As illustrated in FIG. 24, a punch hole is punched in a material for processing by a punch 40, which goes down, and a die hole 35*a*, which is formed in a die 35. A groove 41 is formed in an outer circumference of the punch 40, and a blade is formed even in a corner portion B12 located above the groove 41.

In the punching device, the punch 40 goes down in a Q direction, and punches a hole in the material to be processed by a blade A11 of the front end portion of the punch 40. Even when the burr is generated in the punch hole, the punch 40 further goes down in the Q direction to thereby remove the burr of the material to be processed by the corner portion B12 above the groove 41.

As described above, blades are formed in two portions of the punch 40, and when the punch 40 goes down, a punching operation is performed twice by the blades of the two portions and the die hole 35*a*. Therefore, generation of the burr at the time of punching the sheet is reduced.

However, in the conventional punching device for preventing the burr, it is difficult to sufficiently prevent the burr from being generated.

In the sheet punching device in which the front end portion of the punch is sharply configured, the burr may be generated when punching a sheet having low rigidity such as a thin paper or a sheet placed in the high-humidity environment.

The punching device illustrated in FIG. 24 can effectively remove the burr in a material to be processed, which is relatively hard such as a substrate. However, it is difficult to sufficiently remove the burr in a soft sheet such as a thin paper.

It is due to the following reason. When punching the sheet by the front end portion A11 of the punch 40, the burr is generated on a surface of the sheet on the die 35 side. However, while the punch 40 is moving in the Q direction, the burr is pushed away by the front end portion A11 because the material is soft, and thus it is difficult to remove the burr.

As described above, since the burr cannot be sufficiently removed due to the material of the sheet to be punched or the use environment, there is a need for a sheet punching device that can certainly remove the burr.

SUMMARY OF THE INVENTION

The present invention is directed to a sheet punching device and an image forming apparatus having the sheet punching device.

According to an aspect of the present invention, a sheet punching device includes a first blade, a first die into which the first blade is fitted from a first surface of a sheet to form a punch hole in the sheet, a second blade, and a second die into which the second blade is fitted, wherein the second blade is inserted into the punch hole formed by the first blade from a second surface of the sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
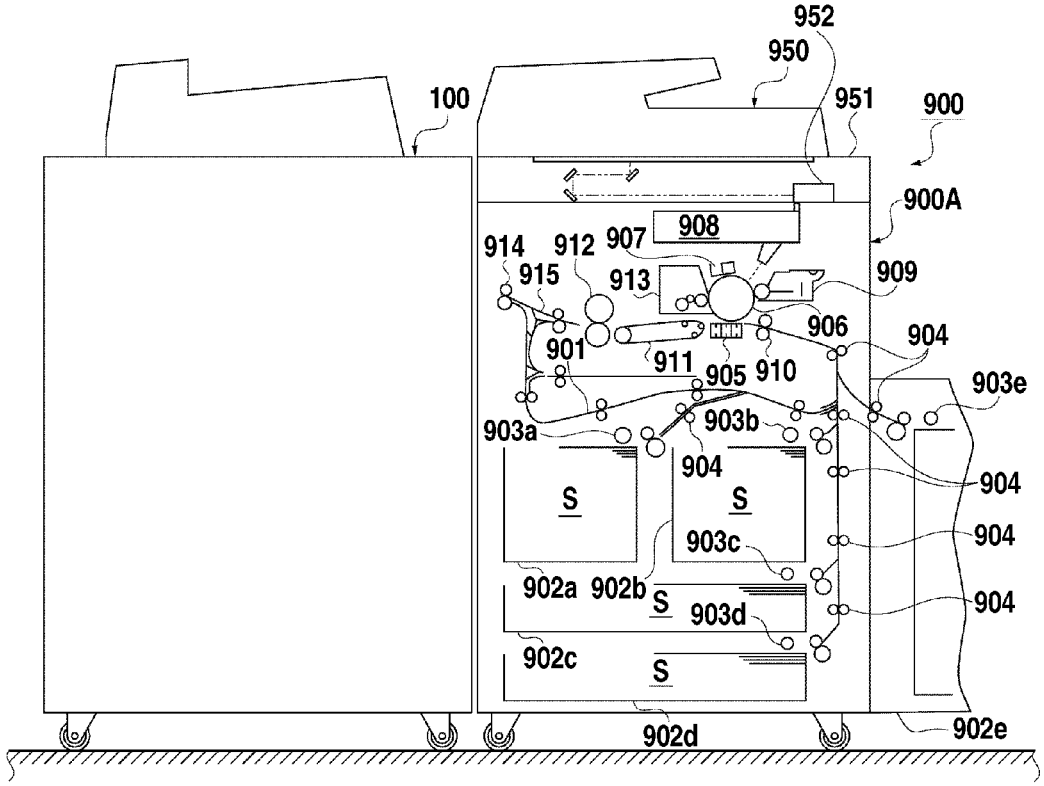
FIG. 1 is a cross-sectional view illustrating a configuration of an image forming apparatus having a sheet punching device according to a first exemplary embodiment of the present invention.

FIG. 1 is a cross-sectional view illustrating a configuration of an image forming apparatus having a sheet punching device according to a first exemplary embodiment of the present invention.

In FIG. 1, an image forming apparatus 900 includes an image forming apparatus body 900A, an automatic document feed device 950 disposed on an upper surface of the image forming apparatus body 900A, and a finisher 100 performing processing of a sheet discharged from the image forming apparatus body 900A. A sheet punching device is mounted in the finisher 100 and will be described below in detail.

The image forming apparatus 900 operates as follows. Transfer paper (hereinafter, referred to as "sheet"), onto which an image is to be transferred, set in paper feed cassettes 902*a*, 902*b*, 902*c*, 902*d*, and 902*e* are fed by paper feed rollers 903*a*, 903*b*, 903*c*, 903*d*, and 903*e*, respectively. The fed sheets are conveyed up to a registration roller 910 by conveyance roller pairs 904.

On a photosensitive drum 906, a process of converting an electrostatic latent image into a visible image is performed by a primary charging unit 907, a development unit 909, and an exposure unit 908. The exposure unit 908 exposes digital document data that is obtained by an image reading device 951 that reads a document previously fed from the automatic document feed device 950. As a result, a copy toner image is formed on the photosensitive drum 906.

At timing when a front end of the sheet meets with a front end of the toner image of the photosensitive drum 906, when the sheet is conveyed up to a transfer unit by the registration roller 910, a transfer bias is applied to the sheet by a transfer separation charging unit 905, so that the toner image on the photosensitive drum 906 is transferred onto the sheet side. The photosensitive drum 906, the primary charging unit 907, the development unit 909, and the transfer unit configure an image forming unit.

The sheet onto which the toner image is transferred is conveyed up to a fixing unit 912 by a conveyance belt 911, and the toner image is thermally fixed by the fixing unit 912. At this time, a blade of a cleaning device 913 scratches and drops down the remaining toner on the photosensitive drum 906 surface, which is not transferred onto the sheet but being stuck to. As a result, the photosensitive drum 906 prepares for a next image forming operation in a state in which a surface thereof is cleared.

The fixed sheet is conveyed to the finisher 100 by a paper discharge roller 914 by switching a switching member 915. A two-sided reversing device 901 reverses the sheet that the image is formed on a first surface, and conveys the reversed sheet to the image forming unit again. The two-sided reversing device 901 is used when forming an image on a second surface of the sheet.

The image forming apparatus 900 of the present exemplary embodiment is configured to convey the sheet on a so-called center basis on which the sheet is conveyed in a state in which a center of a width direction of the sheet coincides with a center of a conveyance path orthogonal to the sheet conveyance direction.

Next, a configuration of a controller for controlling the image forming apparatus 900 is described with reference to FIG. 2.

Figure 2:
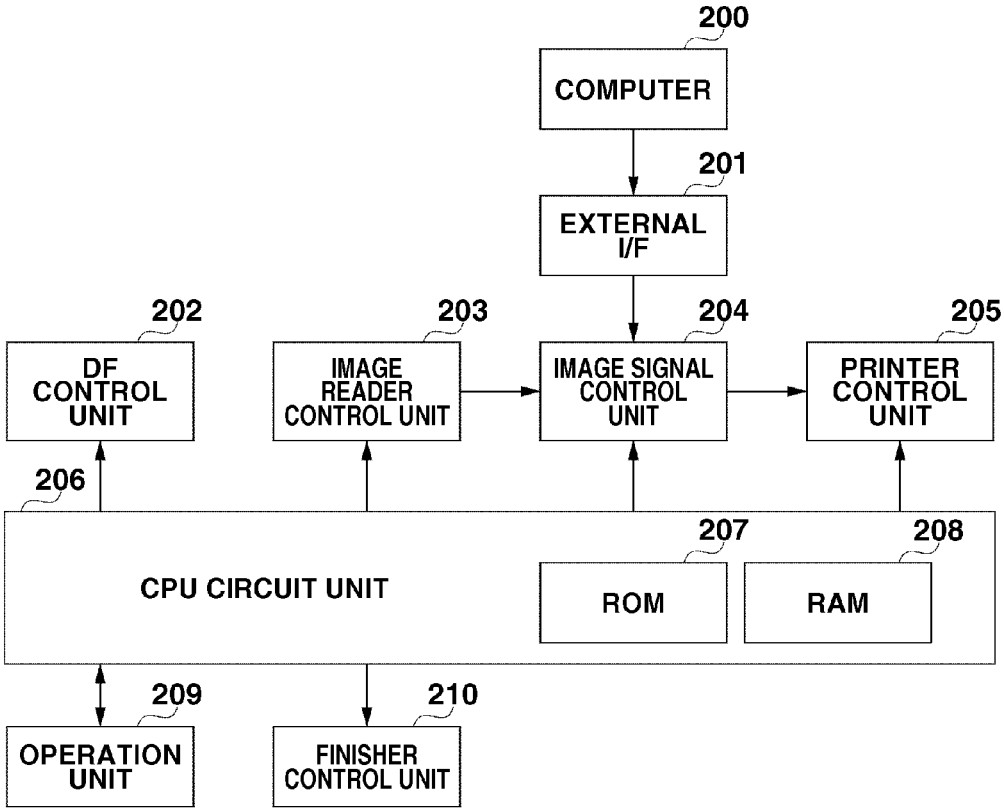
FIG. 2 is a block diagram illustrating a configuration of a control unit of the image forming apparatus.

FIG. 2 is a block diagram illustrating a configuration of a controller for controlling the image forming apparatus 900 in FIG. 1. As illustrated in FIG. 2, the controller includes a central processing unit (CPU) circuit unit 206. The CPU circuit unit 206 includes a CPU (not illustrated), a read only memory (ROM) 207, and a random access memory (RAM) 208 therein. The CPU circuit unit 206 controls a document feeder (DF) control unit 202, an operation unit 209, an image reader control unit 203, an image signal control unit 204, an external I/F 201, a printer control unit 205, and a finisher control unit 210 according to a control program stored in the ROM 207. The RAM 208 temporarily retains control data, and is used as a working area of arithmetic processing associated with control.

The DF control unit 202 drives and controls the automatic document feed device 950 based on an instruction from the CPU circuit unit 206. The image reader control unit 203 performs drive control of a scanner unit (not illustrated) and an image sensor 952, and transmits an analog image signal output from the image sensor 952 to the image signal control unit 204.

The image signal control unit 204 converts the analog image signal from the image sensor 952 into a digital signal, and then performs various kinds of processing. The image signal control unit 204 converts the digital signal into a video signal, and outputs the video signal to the printer control unit 205. The image signal control unit 204 performs various kinds of processing for a digital image signal input from an external computer 200 through the external I/F 201, converts the digital image signal into the video signal, and outputs the video signal to the printer control unit 205.

A processing operation by the image signal control unit 204 is controlled by the CPU circuit unit 206. The printer control unit 205 drives the exposure unit 908 based on the input video signal.

The operation unit 209 includes a plurality of keys for setting various functions for image forming and a display unit for displaying information representing a setting state. The operation unit 209 outputs a key signal corresponding to each key operation to the CPU circuit unit 206, and displays thereof on the display unit based on a signal from the CPU circuit unit 206.

The finisher control unit 210 is mounted in the finisher 100, and exchanges information with the CPU circuit unit 206 of the image forming apparatus 900 to perform drive control of the whole finisher 100. The finisher control unit 210 controls a motor and a sensor installed in the finisher 100.

Figure 3:
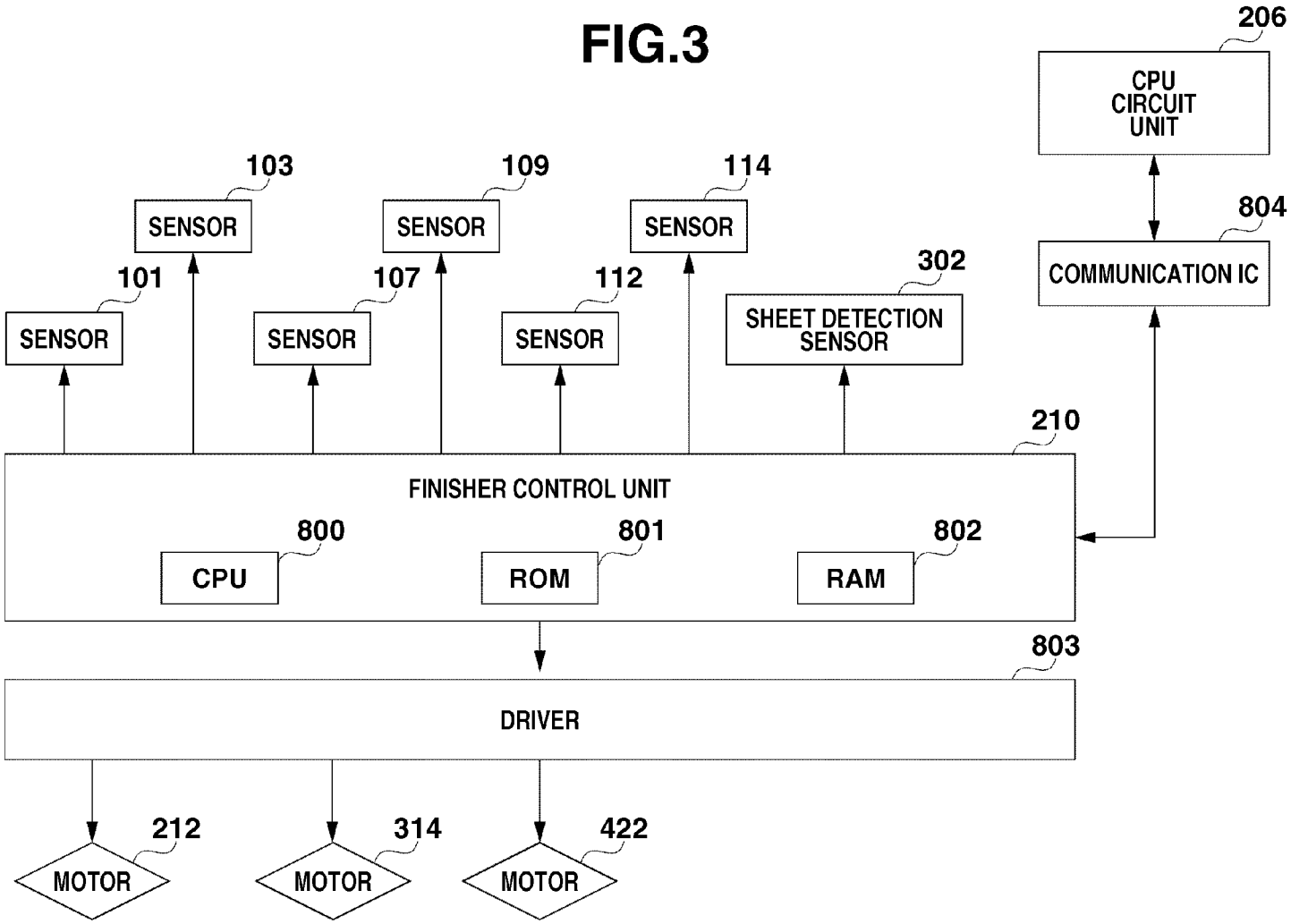
FIG. 3 is a block diagram illustrating a configuration of a control unit of a sheet processing device having the sheet punching device.

Next, a configuration of the finisher control unit 210 that performs drive control of the finisher 100 is described with reference to FIG. 3.

The finisher control unit 210 includes a CPU 800, a ROM 801, and a RAM 802. The finisher controller 210 communicates with the CPU circuit unit 206 installed on the image forming apparatus body 900A side through a communication integrated circuit (IC) 804 to perform data exchange. The finisher control unit 210 executes various programs stored in the ROM 801 based on an instruction from the CPU circuit unit 206, and performs drive control of the finisher 100.

When performing the drive control, the finisher control unit 210 receives detecting signals from various sensors. Sensors 101, 103, 107, 109, 112, and 114 are sensors, which detect sheet conveyance timing and further detects whether the sheet is present on the conveyance path. The finisher control unit 210 is connected with a driver 803, and the driver 803 controls driving of a motor 212, a motor 314, and a motor 422 based on a signal from the finisher control unit 210.

Next, the finisher 100, which stacks and aligns the sheets discharged from the image forming apparatus body 900A and performs stapler-processing for the formed sheet bundle, is described with reference to FIG. 4.

The finisher 100 includes an inlet conveyance roller pair 102, which receives the sheet discharged from the image forming apparatus body 900A, a sheet end detection device 301, a sheet moving device 401, and a sheet punching device 202 according to the present invention. The finisher 100 includes intermediate roller pairs 104, 106, 111, and 113, which convey the sheet in the finisher 100.

The finisher 100 includes the sensors 101, 103, 107, 109, 112, and 114, which detect conveyance timing of the sheet and whether the sheet is present on the conveyance path, are disposed. Further, the finisher 100 includes switching members 105 and 108, which change the conveyance path of the sheet. The sheet end detection device 301, the sheet moving device 401, and the sheet punching device 202 will be described below in detail.

When the switching member 108 is switched to a stacking tray 121 side, the sheet is discharged to the stacking tray 121 by a paper discharge roller pair 110. When the switching member 108 is switched to a stacking tray 122 side, the sheet is conveyed by the intermediate roller pairs 111 and 113 and discharged onto a processing tray 117 by a paper discharge roller 115.

As a return belt 116 and a return paddle 118 rotate, the sheet discharged onto the processing tray 117 is abutted against a sheet rear end alignment wall 123 disposed on the processing tray 117, and aligned in the conveyance direction. Further, alignment is performed in a direction (hereinafter, a conveyance orthogonal direction) orthogonal to the conveyance direction of the sheet by an alignment plate (not illustrated).

After alignment-processing a predetermined number of sheets, sheet bundle processing such as binding processing is performed by a stapler 120, and the sheet bundle is discharged to the stacking tray 122 by a bundle discharge roller pair 119.

A sheet punching unit 201, which forms a plurality of punch holes in the sheet on which the image is formed by the image forming apparatus, is installed in the finisher 100. The sheet punching unit 201 punches the conveyance sheet in which an image is formed one by one. When forming the punch hole in the sheet, the sheet punching unit 201 operates to equally distribute a plurality of punch holes into left and right with respect to the center of the conveyance orthogonal direction of the sheet.

The sheet punching unit 201 includes the sheet end detection device 301, the sheet moving device 401, and the sheet punching device 202. The sheet end detection device 301 includes a sensor 302, which is a device used to detect an end position of the conveyance orthogonal direction of the sheet by the sensor 302. The sheet moving device 401 is a device used to convey the sheet, and conveys the sheet in the conveyance orthogonal direction based on the detection result of the sheet end detection device 301.

The sheet moving device 401 adjusts a position of the sheet so that a plurality of punch holes is equally distributed with respect to the center of the conveyance orthogonal direction of the sheet. The sheet punching device 202 is a device for forming the punch hole in the sheet whose position is adjusted by the sheet moving device 401. The sheet end detection device 301, the sheet moving device 401, and the sheet punching device 202 are described below in detail.

Figure 5:
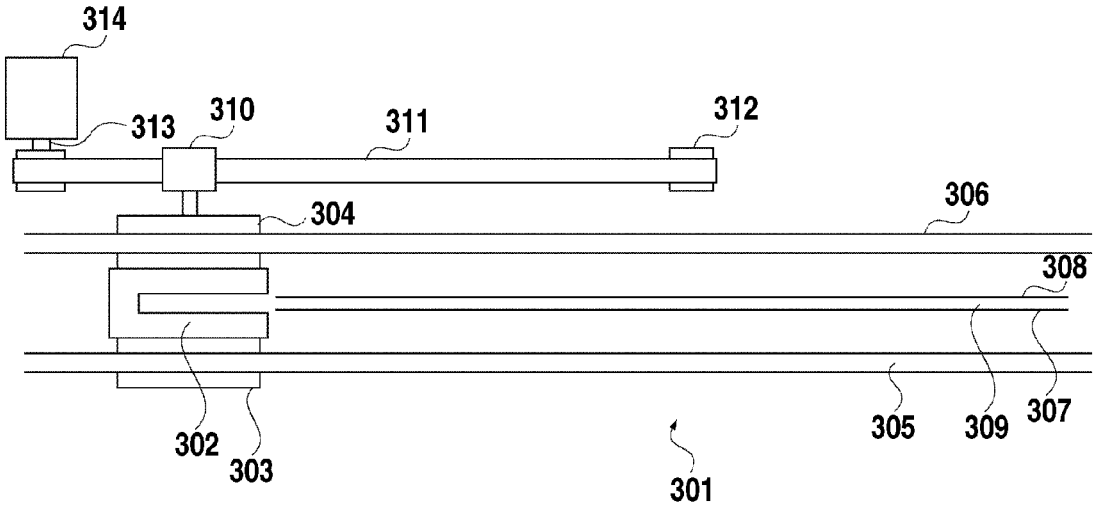
FIG. 5 illustrates a configuration of a sheet end detection device.

First, the sheet end detection device 301 is described. FIG. 5 is a view in which the sheet end detection device 301 is seen from a conveyance direction downstream side of the sheet. When the sheet passes through a conveyance path 309 configured with conveyance guides 307 and 308, the end of the conveyance orthogonal direction of the sheet is detected by the sensor 302. Bearings 303 and 304 are disposed in the sensor 302, and the sensor 302 is movable along guides 305 and 306 fixed to the finisher 100. A driving source for moving the sensor 302 is a motor 314 installed in the finisher 100.

The sensor 302 is connected to a timing belt 311 through a fixing plate 310, and the timing belt 311 is stretched around a pulley 313 disposed on the motor 314 and a pulley 312 fixed to the finisher 100. As the motor 314 rotates, the timing belt 311 operates to move the sensor 302.

A method for detecting the end position of the conveyance orthogonal direction of the sheet by the sheet end detection device 301 is described below. The sheet is conveyed to the finisher 100 on the center basis. Before the sheet end detecting operation, the sensor 302 is on standby at a position sufficiently apart from the end of the conveyance orthogonal direction of the conveyance sheet. While the sheet is passing through the sheet end detection device 301, the motor 314 rotates, so that the sensor 302 is directed toward the end of the conveyance orthogonal direction of the sheet, and the sensor 302 detects the end of the conveyance orthogonal direction of the sheet.

Based on the detection signal of the sensor 302, the finisher control unit 210 calculates how much the sheet is misaligned to the center basis by using the size of the conveyance sheet and a moving distance of the sensor 302.

Figure 6:
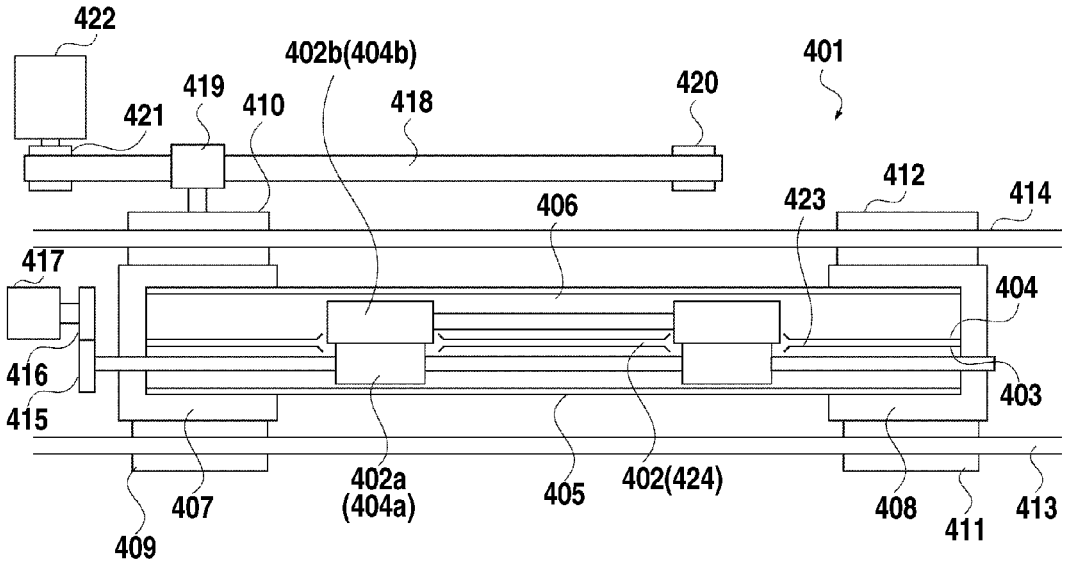
FIG. 6 illustrates a configuration of a sheet moving device.

Next, the sheet moving device 401 is described below. FIG. 6 is a view in which the sheet moving device 401 is seen from a conveyance direction downstream side of the sheet. A conveyance path 423 is configured with conveyance guides 403 and 404, and the sheet is held and conveyed by conveyance roller pairs 402 and 424. The conveyance roller pairs 402 and 424 are connected to a motor 417 through gears 415 and 416 and are configured to positively and reversely rotate in response to the rotation of the motor 417.

The conveyance roller pairs 402 and 424 and the conveyance guides 403 and 404 are supported by frames 405, 406, 407, and 408. Bearings 409, 410, 411, and 412 fixed to the frames 405, 406, 407, and 408 are movable along guides 413 and 414.

A timing belt 418 is installed over a pulley 421 disposed on a motor 422 and a pulley 420 fixed to the finisher 100. The frames 405, 406, 407, and 408 are connected to the timing belt 418 through a fixing plate 419, and moves as the timing belt 418 moves by rotation of the motor 422. In other words, it is possible to move the conveyance roller pairs 402 and 424 in the conveyance orthogonal direction by rotation of the motor 422.

With this configuration, the sheet moving device 401 can moves the sheet in the conveyance orthogonal direction based on the calculation result of the control unit 210, and adjust the sheet position so that the punch holes can be equally distributed with respect to the center of the conveyance orthogonal direction of the sheet.

Figure 7:
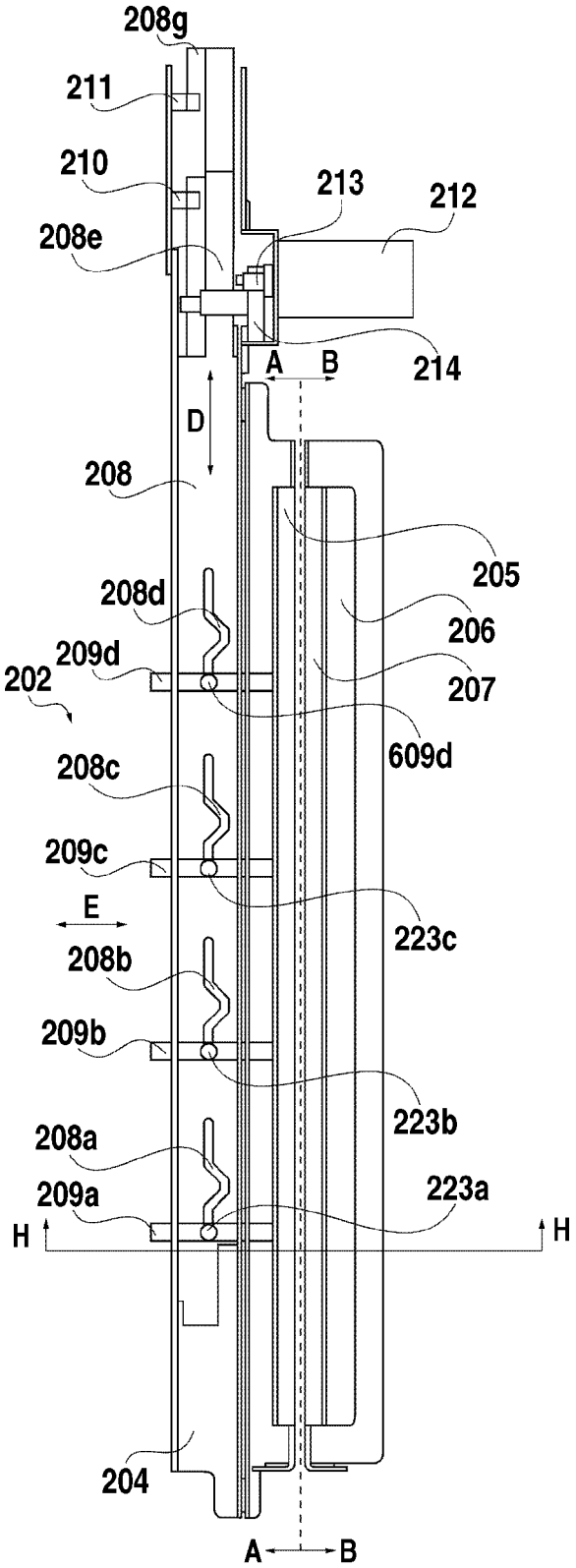
FIG. 7 illustrates a configuration of the sheet punching device.
Figure 8:
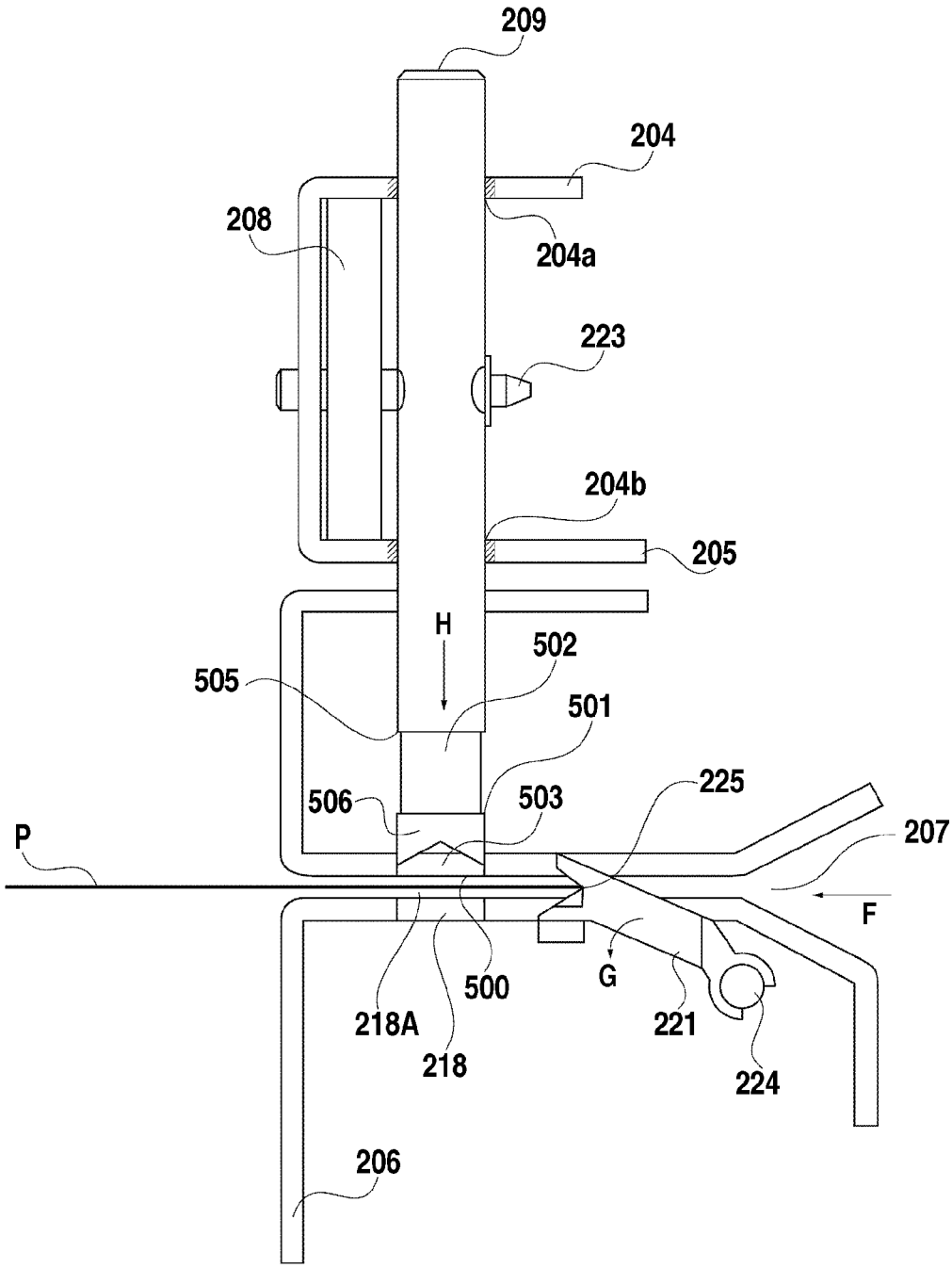
FIG. 8 illustrates an operation of the sheet punching device.

Subsequently, the sheet punching device 202 is described below. FIG. 7 is a view in which the sheet punching device 202 is seen from a conveyance direction upstream side of the sheet. FIG. 8 is a cross-sectional view taken along line H-H of FIG. 7.

A punch 209 collectively means punches 209*a*, 209*b*, 209*c*, and 209*d*. FIG. 8 illustrates a cross-section of the punch 209*a*, but the punch is indicated by 209. Even when a parallel pin is indicated by 223, the same notation is applied. Further, the same notation is also applied to FIGS. 9, 10, 11, 13, and 14, which will be described below.

A punch guide 204 and a second die 205 are fixed by caulking, and the second die 205 and a first die 206 are fixed by caulking. A conveyance path 207 is formed between the second die 205 and the first die 206.

The parallel pins 223*a*, 223*b*, 223*c*, and 223*d* are inserted into the punches 209*a*, 209*b*, 209*c*, and 209*d*. One ends of the parallel pins 223*a*, 223*b*, 223*c*, and 223*d* are inserted into cam grooves 208*a*, 208*b*, 208*c*, and 208*d* formed on a slide rack 208.

The slide rack 208 moves in an arrow D direction of FIG. 7 through the gears 213, 214, and 215, and a rack unit 208*f* of the slide rack 208 by the motor 212. At this time, the parallel pins 223*a*, 223*b*, 223*c*, and 223*d* move along the cam grooves 208*a*, 208*b*, 208*c*, and 208*d* in which V grooves are formed, so that the punches 209*a*, 209*b*, 209*c*, and 209*d* move in an E direction of FIG. 7.

A first die hole 218 (illustrated in FIG. 8) facing the punch 209 is formed in the first die 206. A through hole through which the punch 209 goes is formed in the second die 205. The through hole has a function of a second die hole 503 in FIG. 8.

Next, configurations of the punch 209, the first die hole 218, and the second die hole 503 are described below. As illustrated in FIG. 8, the punch 209 is supported by slide support portions 204*a* and 204*b* of the punch guide 204, and is configured to slidably move up and down. Two blades including a front end blade 500 as a first blade according to the present invention and a stepped blade 501 as a second blade according to the present invention are formed in a front end 506 of the punch 209 and thus reciprocate together.

Before the punch 209 starts a punching operation for the sheet, the front end blade 500 is positioned to face the first die 206. In a state in which the punch 209 punches through the sheet and moves down up to a lowest point, the stepped blade 501 is positioned to face the second die 205. The front end blade 500 and the stepped blade 501 are guided into the first die hole 218 and further guided into the second die hole 503.

A stepped portion 502 is formed along an outer circumference of the punch 209, and the stepped blade 501 is adjacent to the stepped portion 502. A step portion 505 is disposed to face the stepped blade 501. The step portion 505 is configured not to penetrate the first die 206 and protrude into the conveyance path 207 even in a state in which the punch 209 punches the sheet and moves down up to the lowest point. The second die hole 503 is disposed in the second die 205 and has a function of removing the burr of the sheet with the stepped blade 501.

Subsequently, an operation of the sheet punching device is described below. In FIG. 7, as the slide rack 208 is driven by the motor 212, the parallel pins 223*a*, 223*b*, 223*c*, and 223*d* move along the cam grooves 208*a*, 208*b*, 208*c*, 208*c*, and 208*d* in which the V grooves are formed. As illustrated in FIG. 8, the punch 209 moves (moves forward) in an H direction illustrated in FIG. 8, so that the front end blade 500 is fitted into the first die hole 218 of the first die 206 to form the punch hole in the sheet P. Before the punch 209 moves forward, the front end blade 500 is positioned to face the first die 206.

Figure 9:
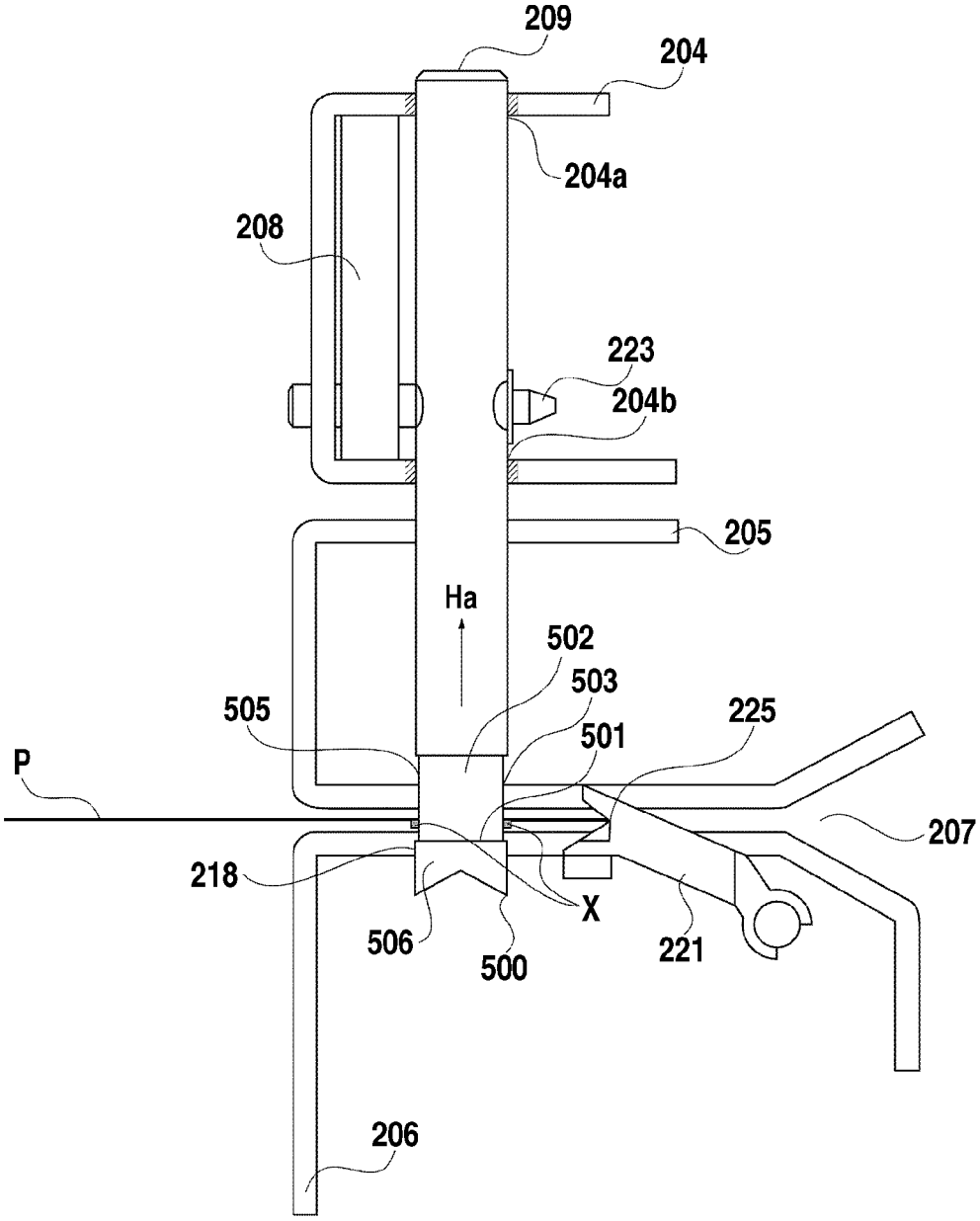
FIG. 9 illustrates an operation of the sheet punching device.

As illustrated in FIG. 9, when the punch 209 reaches the lowest point, the stepped blade 501 is positioned to reach the first die 206 and not to protrude into the conveyance path 207. In other words, the punch 209 moves so that the front end blade 500 goes through an inlet end inner circumference portion 218A of the first die hole 218, formed in the first die 206, from which the front end blade 500 starts to be fitted into.

As described above, since the stepped blade 501 is positioned not to protrude into the conveyance path 207, it is possible to certainly place the sheet between the stepped blade 501 and the second die hole 503.

As illustrated in FIG. 9, depending on cases, the burr X may be generated in the sheet surface of the sheet P on the first die 206 side due to a punching movement (a forward movement, a first movement) of the front end blade 500. For example, the burr may be generated depending on a kind of paper such as a thin paper. If the sheet placed in the high-humidity environment is punched, the burr may also be generated.

When the punch 209 moves (moves backward) in an Ha direction (inverse to the H direction) of FIG. 9 from the lowest position, the burr can be removed by the stepped blade 501 and the second die hole 503. As described above, it is possible to certainly remove the burr, which is difficult to be removed, only by reciprocating the punch 209 to punch the sheet.

Figure 10:
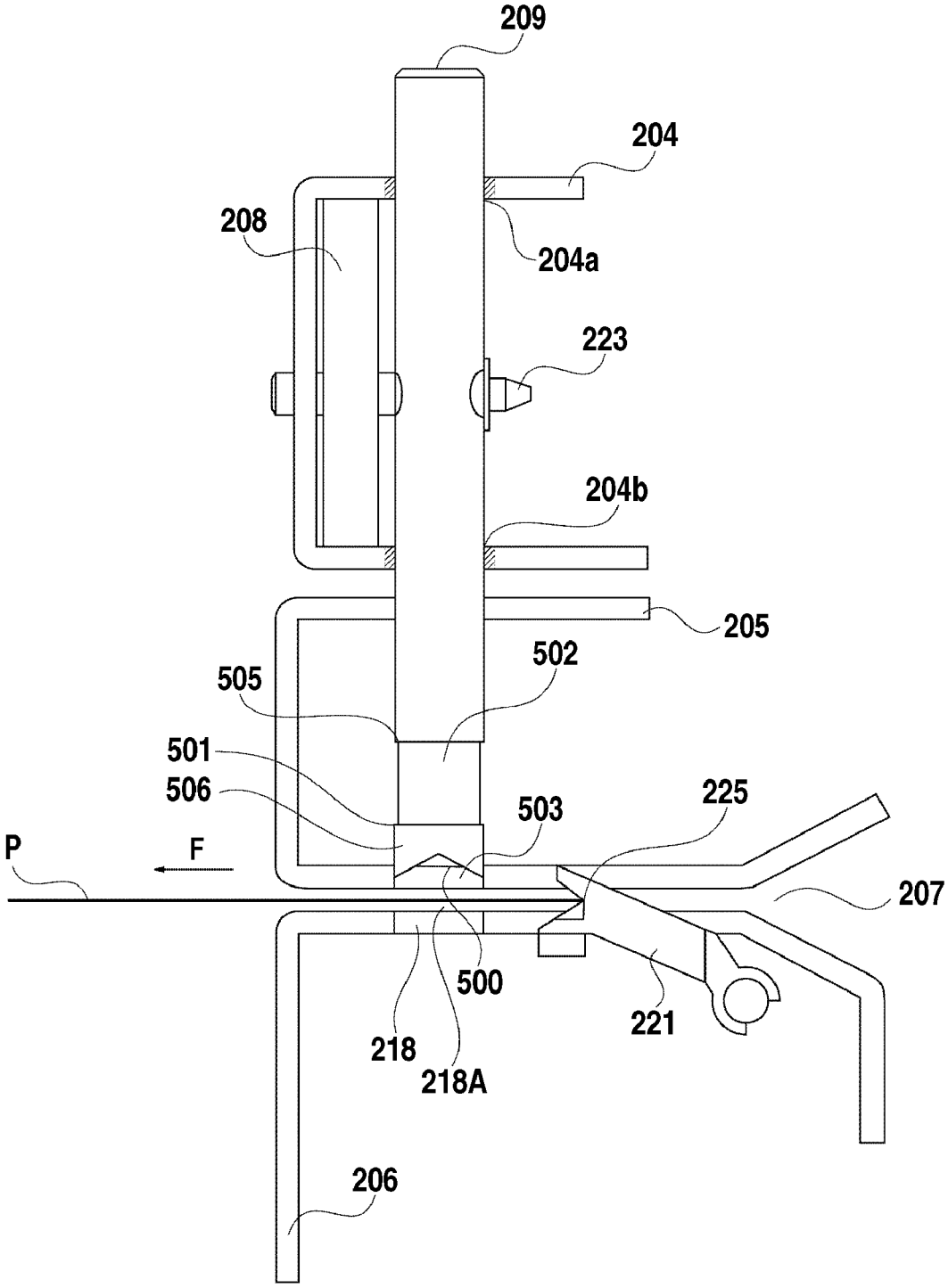
FIG. 10 illustrates an operation of the sheet punching device.

After the reciprocal movement (inverse movement Ha) of the punch 209, as illustrated in FIG. 10, the sheet P is conveyed in an F direction by the conveyance roller pairs 402 and 404. Punch chips generated by punching drop from the first die hole 218, and are accumulated on a punch chip box 203 illustrated in FIG. 4.

As described above, in the reciprocal movement of the punch 209, at the time of moving forward (first movement), the punch hole is punched by the front end blade 500, and then, at the time of moving backward (second movement), the burr generated in the punch hole is removed from the reverse direction by the stepped blade 501 installed in the punch 209. As a result, it is possible to form the punch hole having small generation of the burr.

Next, a configuration for positioning the sheet at a punch position is described below. The rear end of the sheet is abutted against a rear end stopper 221, so that a distance from the sheet rear end to the punch hole portion becomes constant. The sheet P, which enters in the arrow F direction illustrated in FIG. 8, pushes the posterior stopper 221, at the front end of the sheet P, in an arrow G direction in FIG. 8, centering on a rotation fulcrum point 224.

When the rear end of the sheet P comes out of the rear end stopper 221, the rear end stopper 221 returns to its original position by a spring (not illustrated) connected to the rear end stopper 221. Thereafter, the sheet P is conveyed in a reverse direction by the conveyance roller pairs 402 and 424, and abutted against a abutting portion 225 of the rear end stopper 221, so that the punching position of the sheet P from the sheet rear end is determined.

Figure 11A:
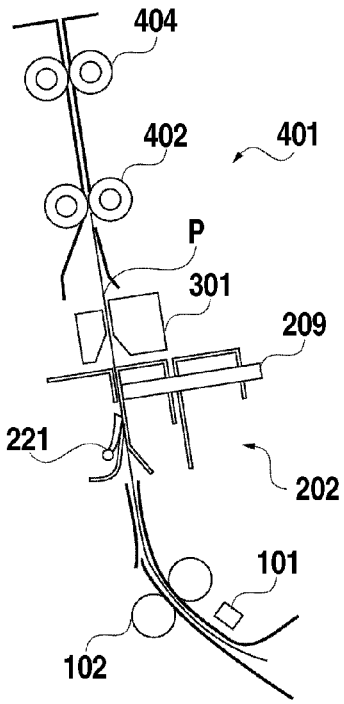
FIGS. 11A to 11D illustrate an operation of a sheet punching unit.
Figure 12:
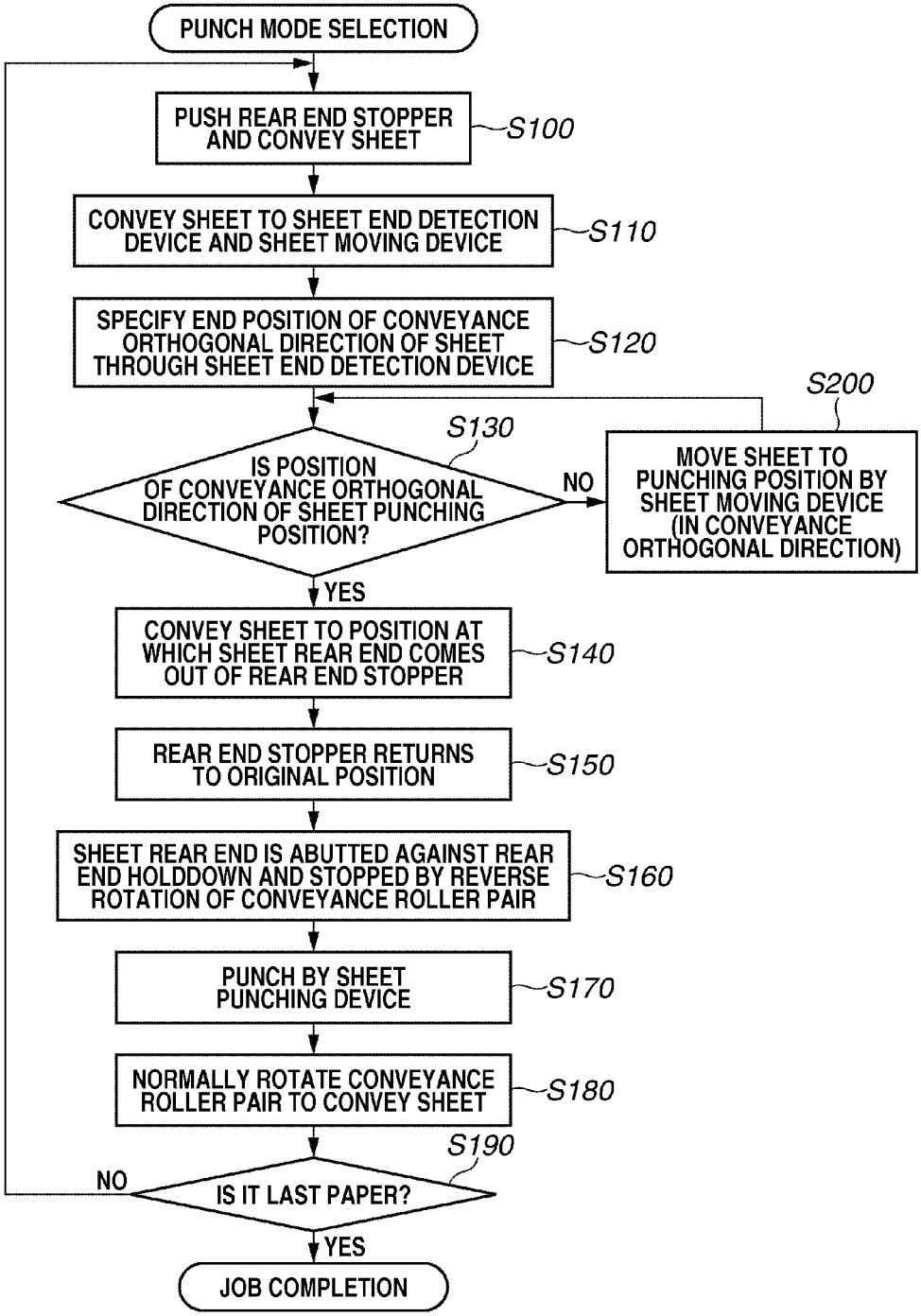
FIG. 12 is a flowchart illustrating an operation of the sheet punching unit.

FIG. 12 is a flowchart illustrating an operation of the sheet punching unit 201, which is described below. As illustrated in FIG. 11A, the sensor 101 detects that the sheet P discharged from the image forming apparatus body 900A enters the finisher 100. The sheet P is held and conveyed by the inlet conveyance roller pair 102, and reaches the sheet punching device 202. In step S100, the sheet P pushes off the rear end stopper 221, and in step S110, the sheet P passes through the sheet end detection device 301, and arrives at the sheet moving device 401.

At this time, in step S120, the sensor 302 of the sheet end detection device 301 detects the end of the conveyance orthogonal direction of the sheet, and specifies the end position of the conveyance orthogonal direction of the sheet P. When the end position of the conveyance orthogonal direction of the sheet P is specified (YES in step S130), the sheet P is moved to a predetermined conveyance orthogonal direction position by the sheet moving device 401 to meet the punching position of the sheet punching device 202.

The operation is performed without stopping conveyance of the sheet P by the sheet moving device 401, and thus it can prevent productivity of the finisher 100 from being degraded.

Figure 11B:
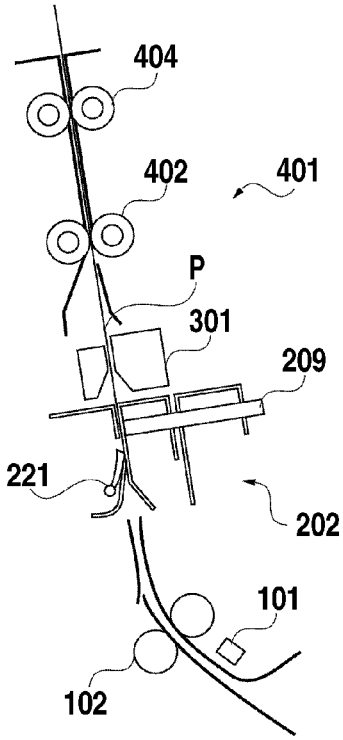

Next, in step S140, the rear end of the sheet P passes through the rear end stopper 221 as illustrated in FIG. 11B, and in step S150, the rear end stopper 221 returns to its original position by a spring, which is not illustrated. Thereafter, the conveyance roller pairs 402 and 404 of the sheet moving device 401 stop once and then start reverse rotation.

Figure 11C:
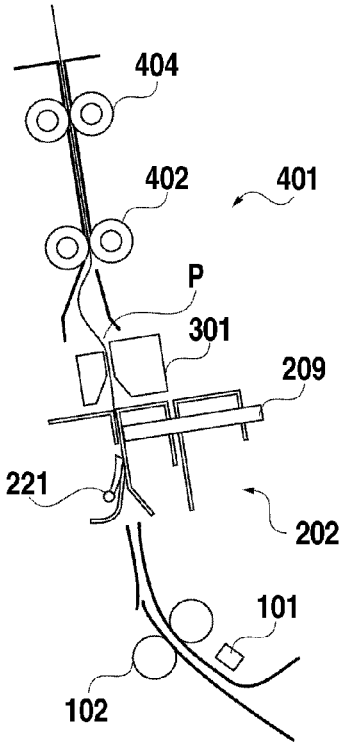

Next, in step S160, as illustrated in FIG. 11C, the rear end of the sheet P is abutted against the rear end stopper 221 by the conveyance roller pairs 402 and 404, which has started reverse rotation, and a predetermined loop is formed to correct inclination of the sheet P. Thereafter, in step S170, the punch 209 is driven to form the punch hole in the sheet P.

Figure 11D:
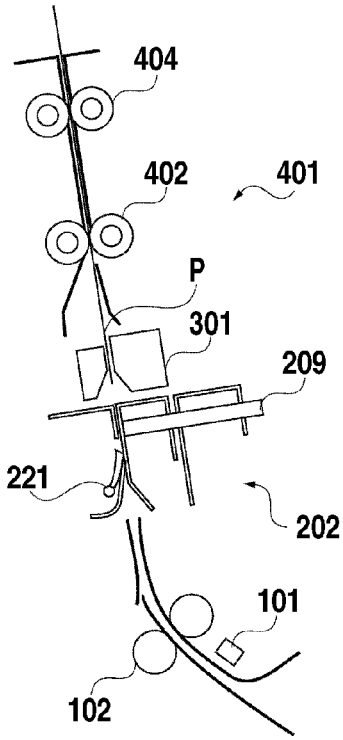

Thereafter, in step S180, as illustrated in FIG. 11D, the conveyance roller pairs 402 and 424 normally rotate, so that the sheet P is conveyed. In step S190, it is checked whether the sheet P is a last paper. If it is the last paper (YES in step S190), the processing is finished, and if a following sheet is present, the processing returns to step S100 to continue the processing.

In the first exemplary embodiment, when the punch 209 reaches the lowest point as illustrated in FIG. 9, the stepped blade 501 reaches up to the first die 206, and is positioned not to protrude into the conveyance path 207. Since the stepped blade 501 is positioned not to protrude into the conveyance path 207, it is possible to certainly position the sheet between the stepped blade 501 and the second die hole 503. Therefore, it is possible to certainly perform a burr removal operation at the time of moving backward (second movement).

In a second exemplary embodiment, when the punch 209 reaches the lowest point, even though the stepped blade 501 protrudes into the conveyance path 207, it is possible to certainly position the sheet between the stepped blade 501 and the second die hole 503. The present exemplary embodiment is described below in detail below.

Figure 13:
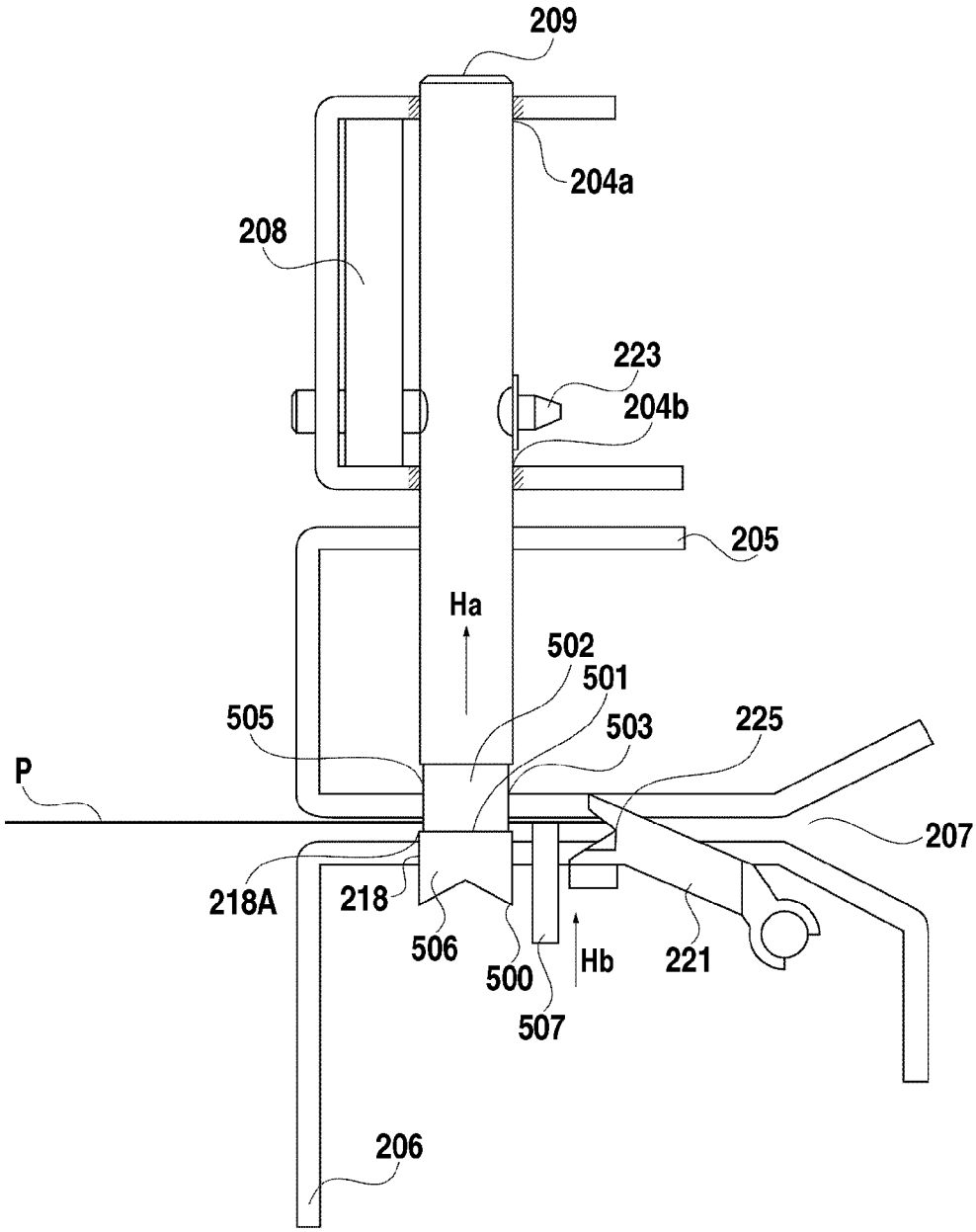
FIG. 13 illustrates an operation of a sheet punching device according to a second exemplary embodiment.

FIG. 13 is a view illustrating an operation of a sheet punching device 202 according to the second exemplary embodiment. FIG. 13 illustrates a state in which the front end blade 500 enters the first die hole 218 of the first die 206 to form the punch hole in the sheet P, and the punch 209 reaches the lowest point.

A configuration of the sheet punching device 202 is almost the same as that of the first exemplary embodiment, and the similar components are denoted by the same reference numerals. The operation is also almost the same as that in the first exemplary embodiment, and thus description of the similar operation will not be repeated. A different point is that a pressing member 507, which is retractable, is disposed. The pressing member 507 is described below in detail.

In FIG. 13, the sheet punching device 202 includes the pressing member 507, which is retractable from the first die 206 for the conveyance path 207 by a solenoid (not illustrated). The pressing member 507 moves in an Hb direction to press the sheet P onto the second die 205. In this state, even though the punch 209 reaches the lowest point, the stepped blade 501 does not reach the first die 206.

As described above, when the punch 209 moves forward, the punch hole is formed in the sheet P by the front end blade 500, and thereafter the sheet P is pressed onto the second die 205 by the pressing member 507 to thus move the sheet P between the stepped blade 501 and the second die hole 503.

Thereafter, in a state in which the sheet P is positioned between the stepped blade 501 and the second die hole 503, the punch 209 moves backward, and thus the burr of the sheet P is removed by the stepped blade 501 and the second die hole 503.

After the burr removal operation, the pressing member 507 moves back to the second die 206 not to protrude into the conveyance path 207. As described above, when the punch 209 reaches the lowest point, even though the stepped blade 501 does not pass through the inlet end inner circumference portion 218A of the first die 206, it is possible to certainly perform the burr removal operation.

Figure 14:
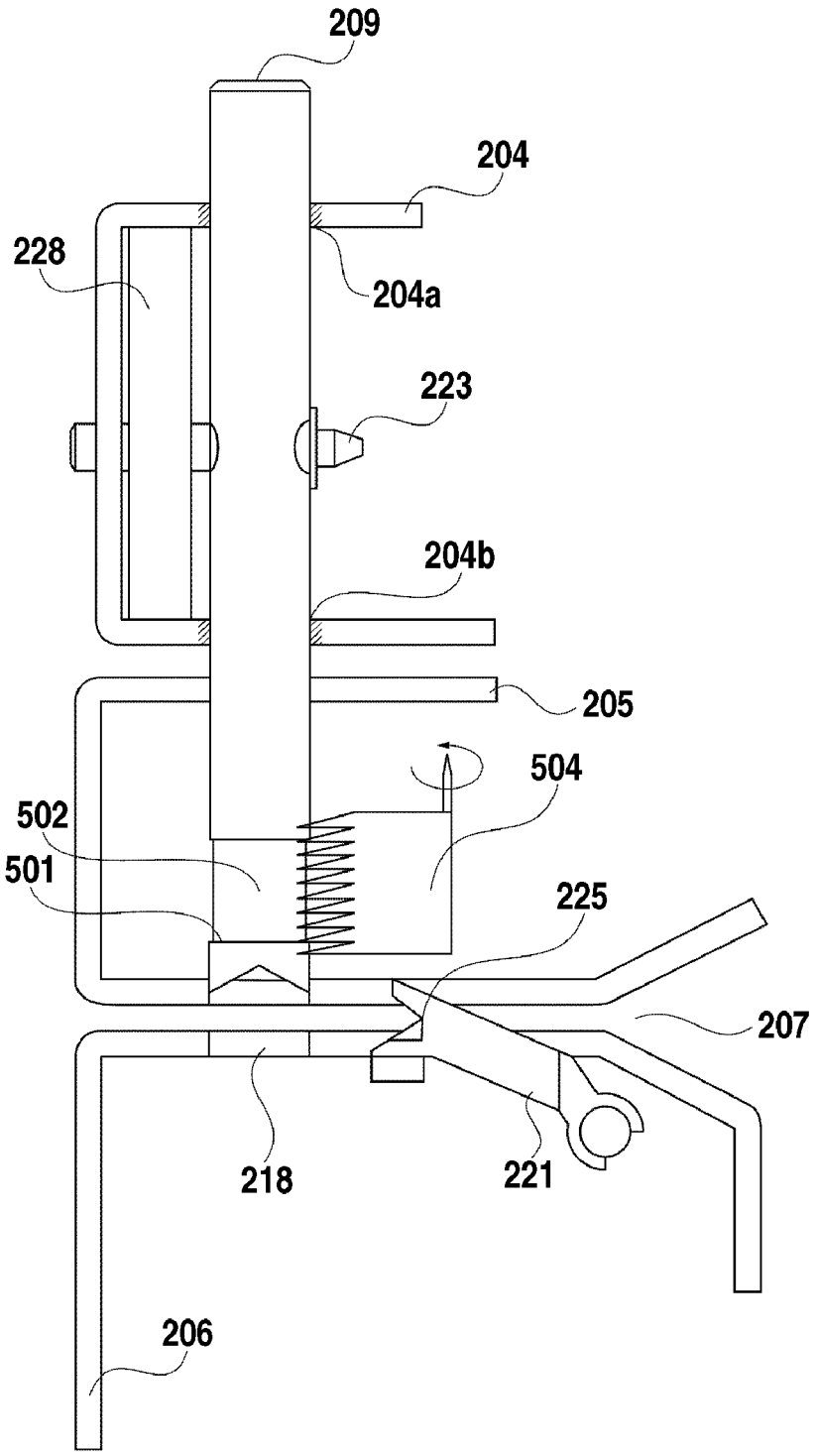
FIG. 14 illustrates a configuration of a chip removing mechanism of a sheet punching device according to a third exemplary embodiment.

FIG. 14 is a view illustrating a configuration of a brush 504 (a chip removing mechanism) of the sheet punching device 202. A configuration of the sheet punching device 202 according to a third exemplary embodiment is almost the same as that in the first and second exemplary embodiments, and the similar components are denoted by the same reference numerals. The operation is also almost the same as that in the first and second exemplary embodiments, and thus description of the similar operation will not be repeated.

A different point is that the brush 504 for removing paper powder accumulated on the stepped blade 501 and the stepped portion 502 of the punch 209 is disposed. The brush 504 is described below in detail.

As illustrated in FIG. 14, the brush 504 (the chip removing mechanism) for removing paper powder accumulated on the stepped blade 501 and the stepped portion 502 of the punch 209 are disposed. The brush 504 is configured with an elastic body, and rotates in an arrow direction illustrated in FIG. 14 for the punch 209, which has moved back from the conveyance path 207, to remove paper powder accumulated on the stepped blade 501 and the stepped portion 502.

As the chip removing mechanism, the brush 504 may be disposed to surround the punch 209, which has moved back from the conveyance path 207. In this case, paper powder accumulated on the stepped portion 502 is removed by the reciprocal movement of the punch 209.

As described above, the brush 504 is disposed to remove paper powder accumulated on the stepped portion 502. It is possible to prevent the removed burr from remaining due to a repeated use, and thus it is possible to maintain the burr removal performance.

A configuration of the sheet punching device 202 according to a fourth exemplary embodiment is described below. The fourth exemplary embodiment is different from the first exemplary embodiment in configurations of the finisher control unit 210 and the sheet punching device 202, which is described below in detail. The other configuration is almost the same, and the similar components are denoted by the same reference numerals. The operations of the components other than the finisher control unit 210 and the sheet punching device 202 are almost the same as that in the first exemplary embodiment, and description of the similar operations will not be repeated.

Figure 15:
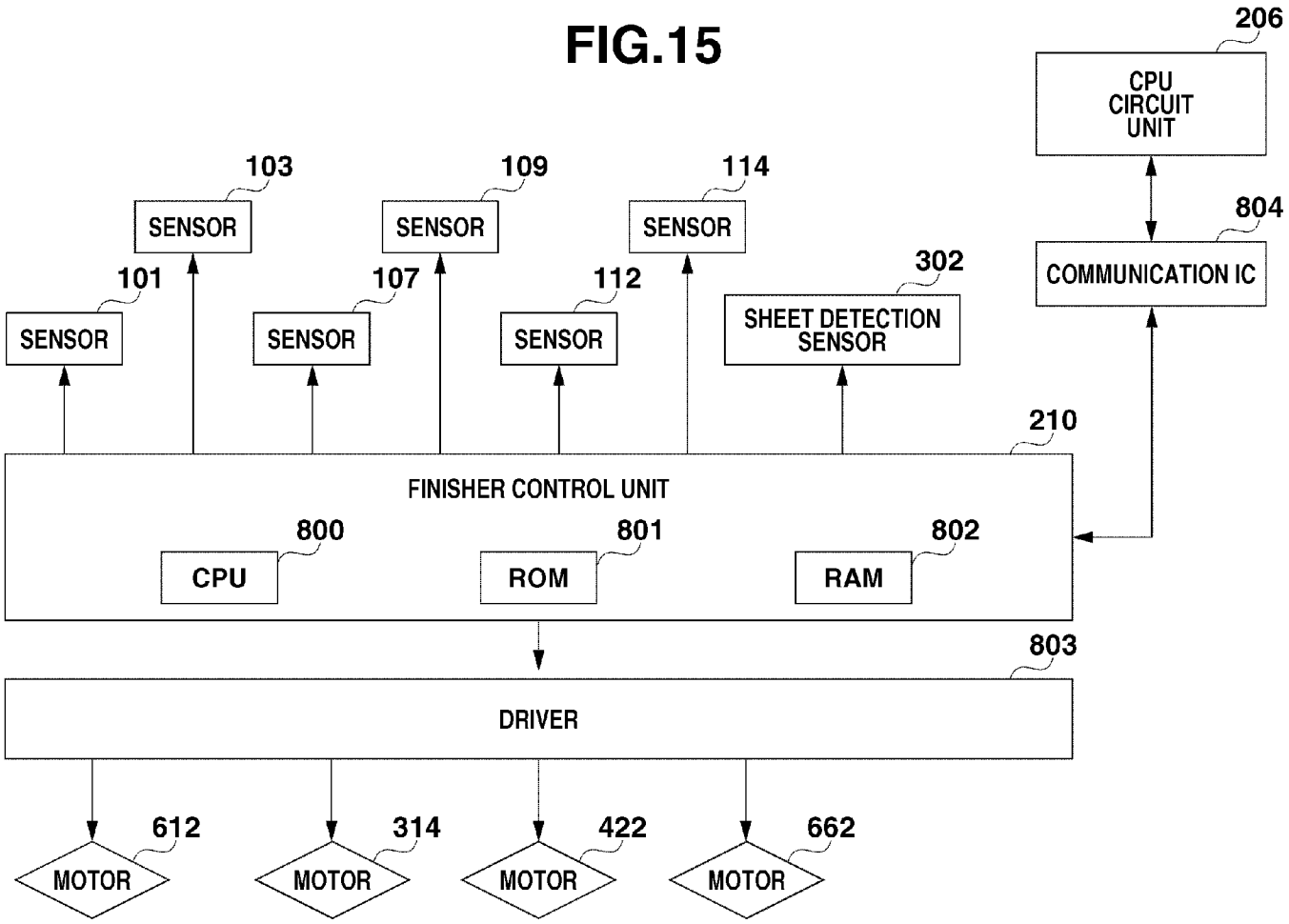
FIG. 15 is a block diagram illustrating a configuration of a control unit of a sheet processing device having a sheet punching device according to a fourth exemplary embodiment.

Next, a configuration of the finisher control unit 210, which performs drive and control of the finisher 100, is described with reference to FIG. 15. The finisher control unit 210 includes a CPU 800, a ROM 801, and a RAM 802.

The finisher control unit 210 communicates with the CPU circuit unit 206 disposed on the image forming apparatus body 900A side through the communication IC 804 to perform data exchange. The finisher control unit 210 executes various programs stored in the ROM 801 according to an instruction from the CPU circuit unit 206 to perform drive and control of the finisher 100.

When performing the drive control, the finisher control unit 210 receives detection signals from various sensors. The sensors 101, 103, 107, 109, 112, and 114 are sensors to detect conveyance timing of the sheet and further detect whether the sheet is present on the conveyance path.

The finisher control unit 210 is connected with a driver 803, and the driver 803 drives a motor 612, a motor 314, a motor 422, and a motor 662 based on a signal from the finisher control unit 210.

The finisher 100 has the similar configuration as in the first exemplary embodiment, and thus description thereof will not be repeated.

Figure 4:
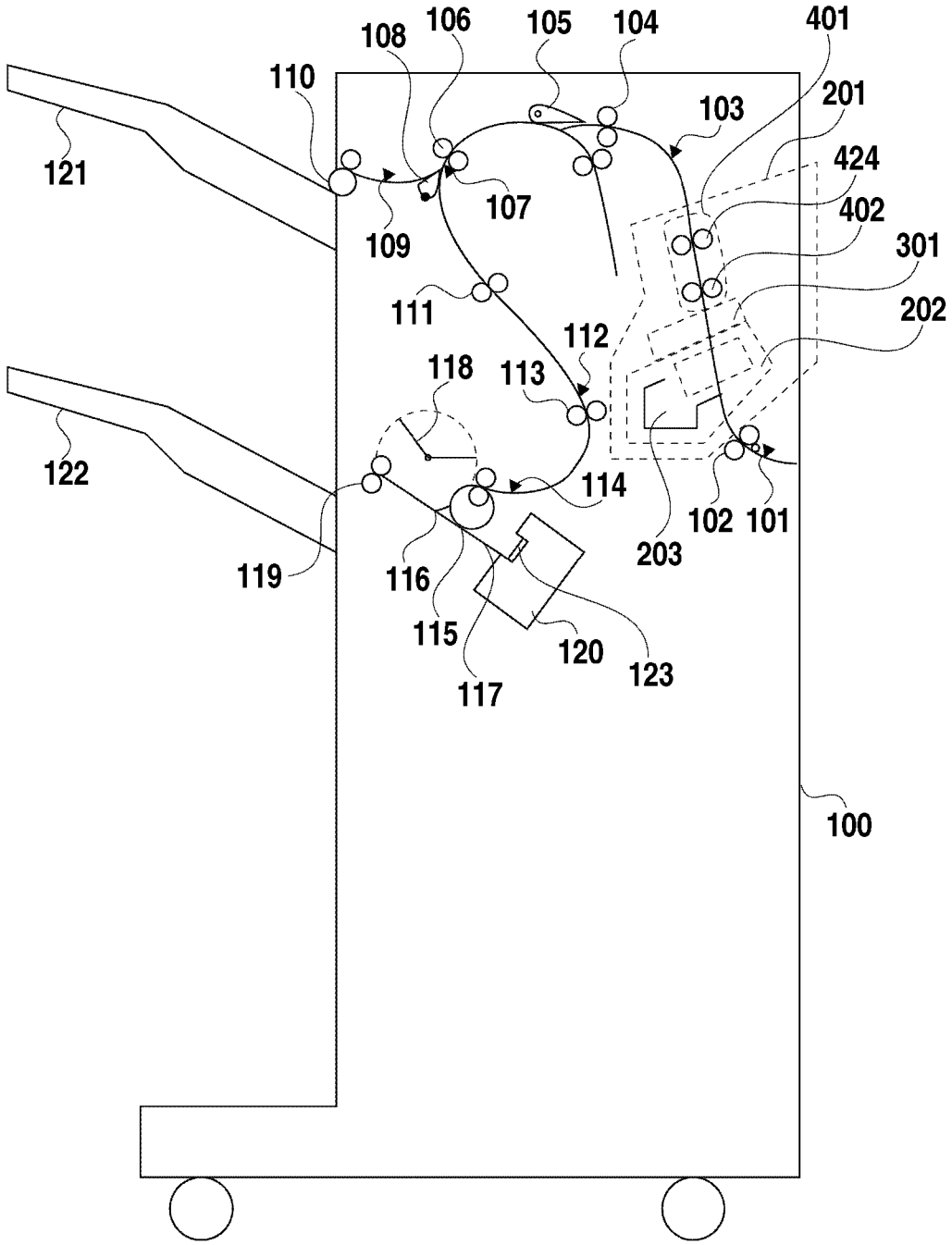
FIG. 4 illustrates a configuration of the sheet processing device having the sheet punching device.

As illustrated in FIG. 4, the sheet punching unit 201, which forms the punch holes in the sheet on which the image is formed by the image forming apparatus, is disposed in the finisher 100. The sheet punching unit 201 punches the conveyed sheet on which the image is formed one by one. When forming the punch hole in the sheet, the sheet punching unit 201 operates to equally distribute the punch holes with respect to a center of the conveyance orthogonal direction of the sheet.

The sheet punching unit 201 includes the sheet end detection device 301, the sheet moving device 401, and the sheet punching device 202. The sheet end detection device 301 and the sheet moving device 401 have the similar configurations as those in the first exemplary embodiment, and thus description thereof will not be repeated.

Figure 16:
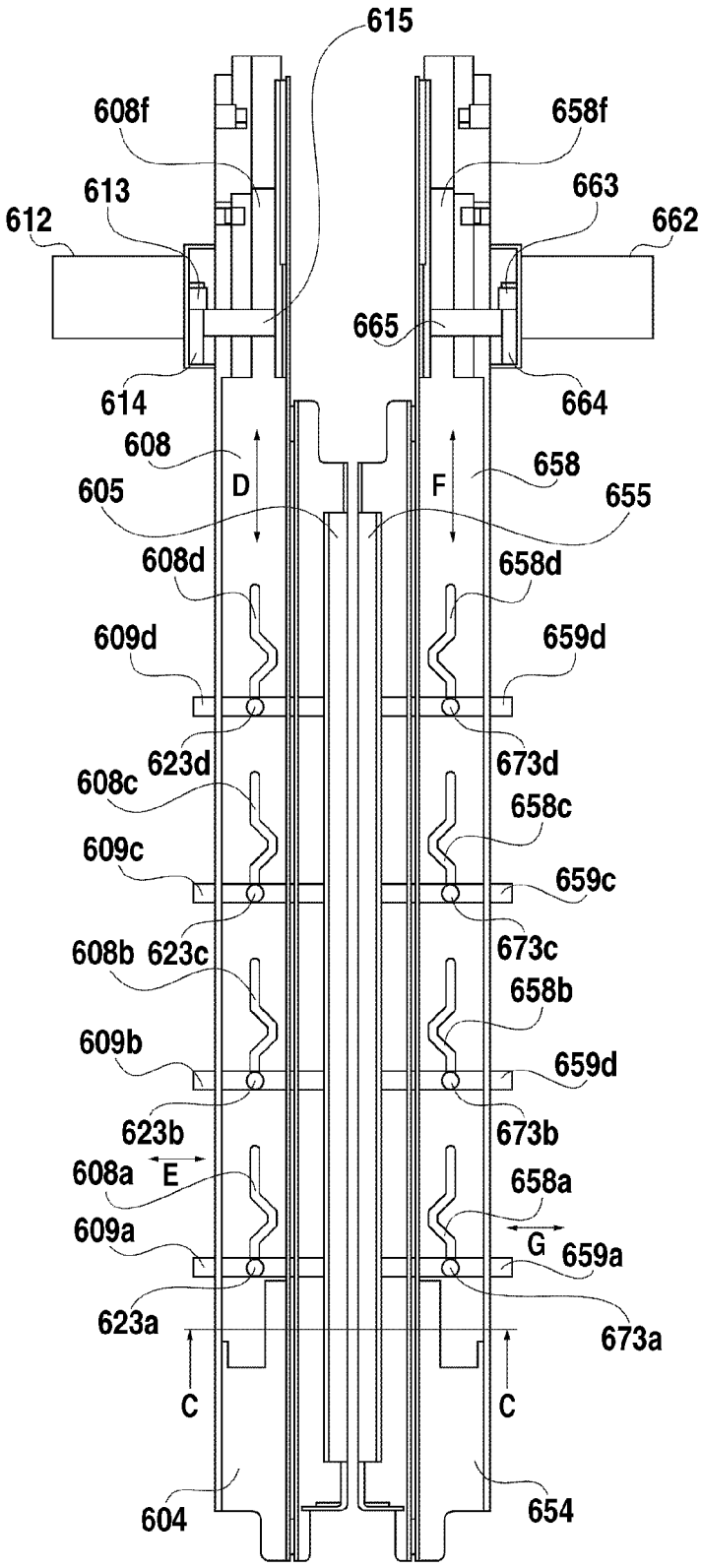
FIG. 16 illustrates a configuration of the sheet punching device.
Figure 17:
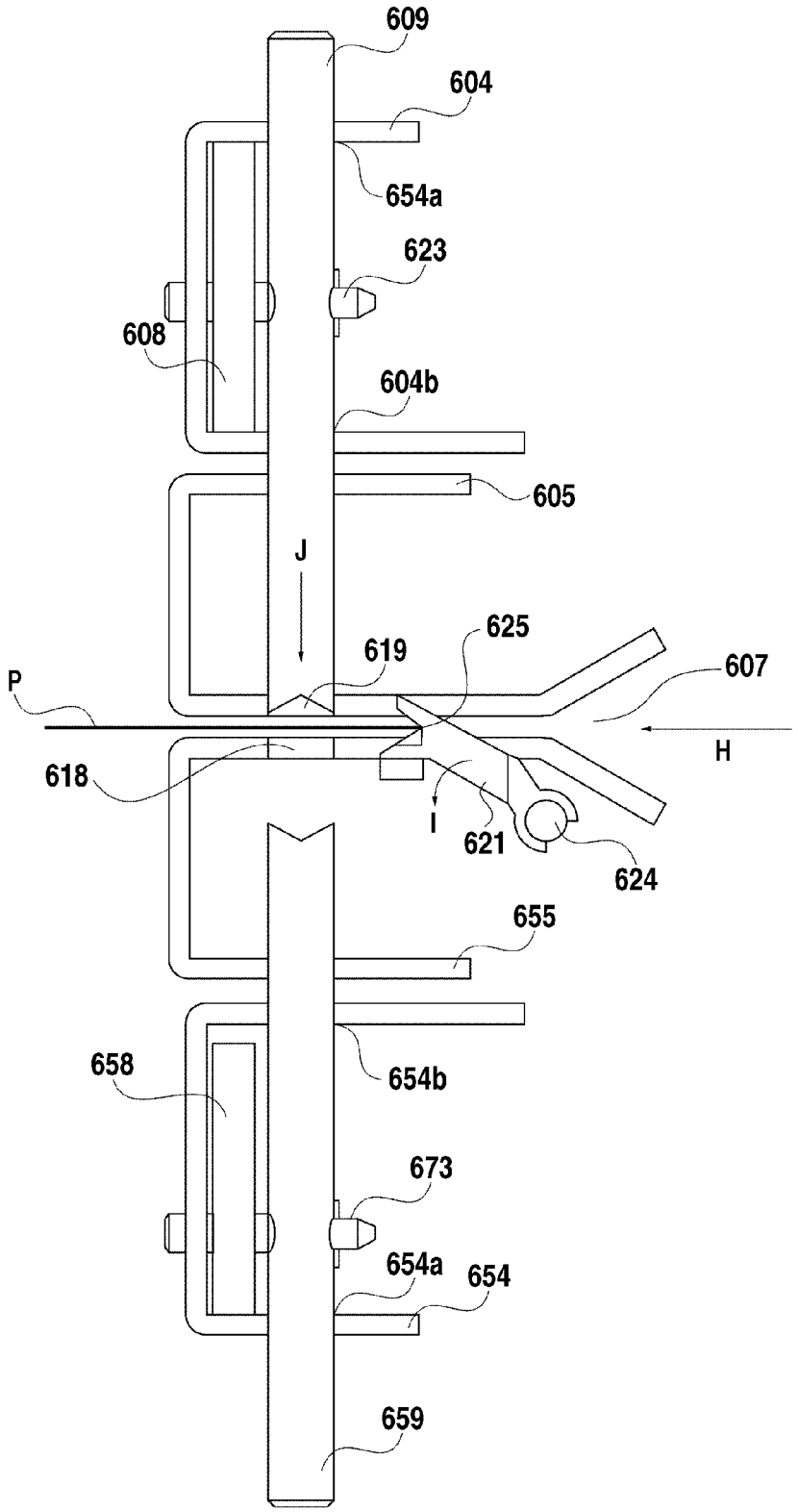
FIG. 17 illustrates an operation of the sheet punching device.

The sheet punching device 202 is described below. FIG. 16 is a view in which the sheet punching device 202 is seen from a conveyance direction upstream side of the sheet, and FIG. 17 is a cross-sectional view taken along line C-C of FIG. 16.

A first blade 609 collectively means first blades 609*a*, 609*b*, 609*c*, and 609*d*. FIG. 17 illustrates a cross-section of the first blade 609*a*, but the first blade is indicated by 609. Even when a first parallel pin is denoted by 623, a second blade is denoted by 659, and a second parallel pin is denoted by 673, the same notations are applied. Further, the same notations are also applied to those components in FIGS. 17, 18, 19, 20, 21, 22, and 23, which will be described below.

A first punch guide 604 and a second die 605 are fixed by caulking. A second punch guide 654 and a first die 655 are fixed by caulking. The second die 605 and the first die 655 are fixed by caulking. A conveyance path 607 is formed between the second die 605 and the first die 655.

The first blade 609 is supported by first punch slide support portions 604*a* and 604*b* of the first punch guide 604, is configured to slidably move up and down, and is configured to punch the sheet. The second blade 659 is supported by second punch slide support portions 654*a* and 654*b* of the second punch guide 654, is configured to slidably move up and down, and is configured to punch the sheet.

The first parallel pins 623*a*, 623*b*, 623*c*, and 623*d* are inserted into the first blades 609*a*, 609*b*, 609*c*, and 609*d*. One ends of the first parallel pins 623*a*, 623*b*, 623*c*, and 623*d* are inserted into first cam grooves 608*a*, 608*b*, 608*c*, and 608*d* formed in a first slide rack 608.

The first slide rack 608 moves in an arrow D direction of FIG. 16 through gears 613, 614, and 615 and a rack unit 608*f* of the first slide rack 608 by the motor 612. At this time, the first parallel pins 623*a*, 623*b*, 623*c*, and 623*d* move along the cam grooves 608*a*, 608*b*, 608*c*, and 608*d* in which V grooves are formed, so that the first blades 609*a*, 609*b*, 609*c*, and 609*d* move in an E direction illustrated in FIG. 16.

The second blade 659*a* and the first blade 609*a* are separate bodies from each other, are disposed to face each other, and are coaxially disposed. Similarly, the second blades 659*b*, 659*c*, and 659*d* and the first blades 609*b*, 609*c*, and 609*d* are disposed to face each other and coaxially disposed respectively. The first blade 609 is guided into the second die hole 619 to move to be fitted into the first die 655. The second blade 659 is guided into the first die hole 618 to move to be fitted into the second die 605. The second parallel pins 673*a*, 673*b*, 673*c*, and 673*d* are inserted into the second blades 659*a*, 659*b*, 659*c*, and 659*d*.

One ends of the second parallel pins 673*a*, 673*b*, 673*c*, and 673*d* are inserted into the cam grooves 658*a*, 658*b*, 658*c*, and 658*d* formed in the second slide rack 658. The slide rack 658 moves in an arrow F direction illustrated in FIG. 16 through the gears 663, 664, and 665 and the rack unit 658*f* of the slide rack 658 by the motor 662.

At this time, the second parallel pins 673*a*, 673*b*, 673*c*, and 673*d* move along the cam grooves 658*a*, 658*b*, 658*c*, and 658*d* in which V grooves are formed, so that the second blades 659*a*, 659*b*, 659*c*, and 659*d* move in a G direction in FIG. 16.

The punching operation of the sheet punching device 202 is described below. First, as the slide rack 608 is driven by the motor 612, the parallel pins 623*a*, 623*b*, 623*c*, and 623*d* move along the cam grooves 608*a*, 608*b*, 608*c*, and 608*d* in which V grooves are formed.

As illustrated in FIG. 17, the first blade 609 moves in a J direction in FIG. 17. The first blade 609 enters the first die hole 618 of the first die 655 and punches the punch hole in the sheet P.

Figure 18:
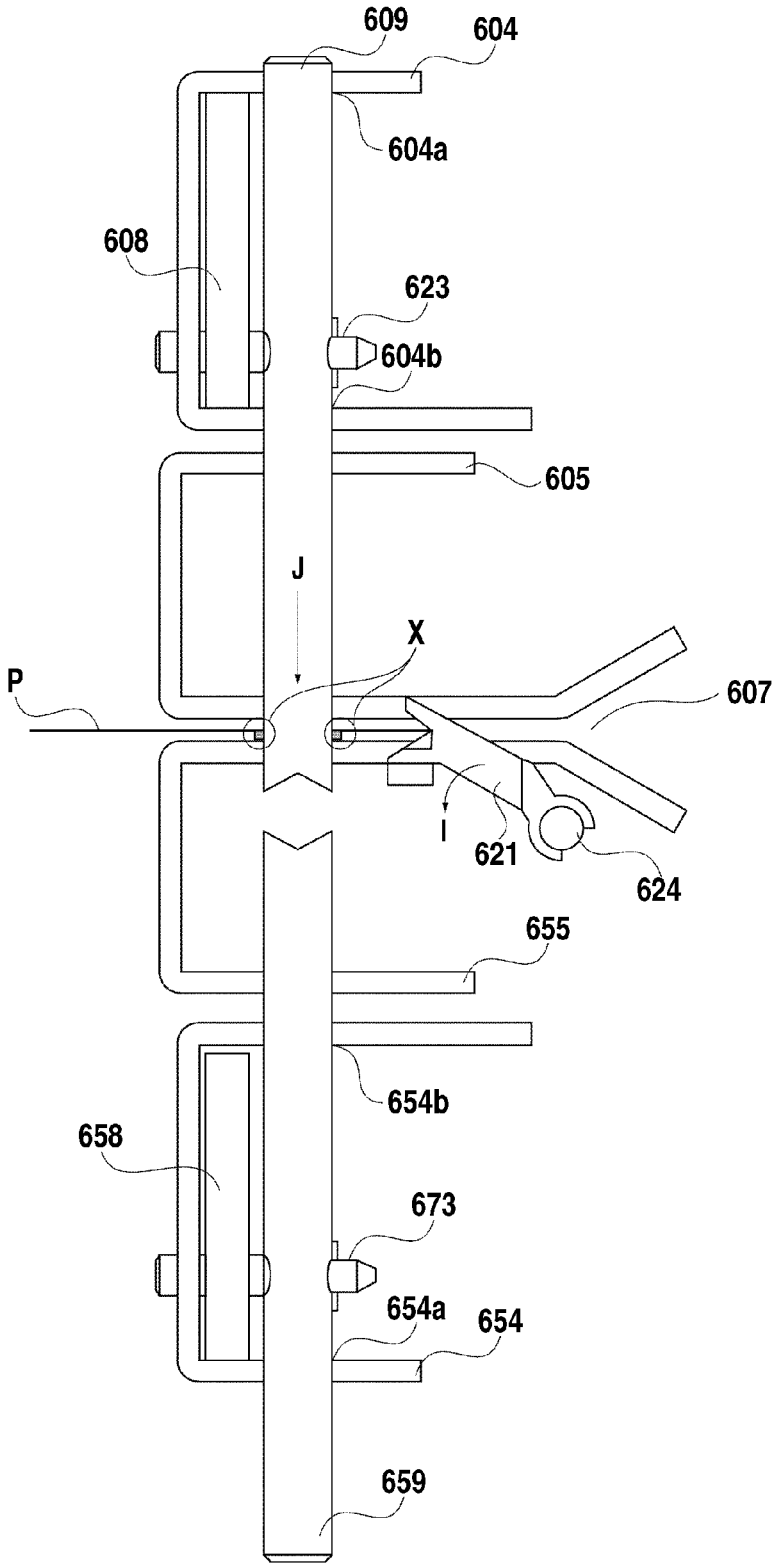
FIG. 18 illustrates an operation of the sheet punching device.

As illustrated in FIG. 18, depending on, for example, a paper type of the sheet, the burr X may be generated in the sheet surface of the sheet P on the first die 655 side. If the sheet placed in the high-humidity environment is punched, the burr may be similarly generated in the sheet surface on the first die 655 side.

Figure 19:
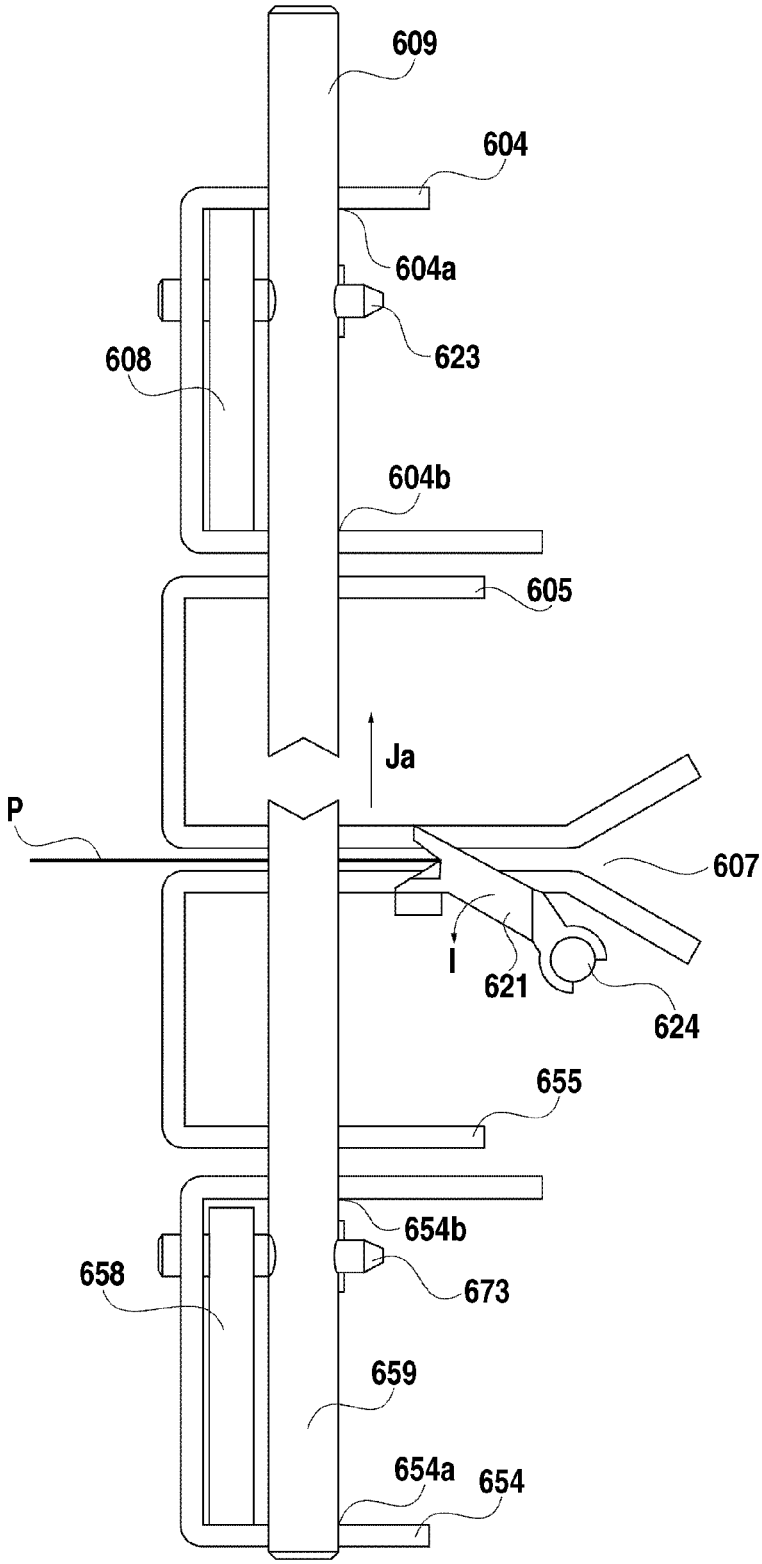
FIG. 19 illustrates an operation of the sheet punching device.

In order to remove the burr X, as illustrated in FIG. 19, after punching, the first blade 609 moves back in a Ja direction, and the second blade 659 moves in a Ja direction to be fitted into the second die hole 619 of the second die 605. It is possible to remove the burr X through this operation.

The second blade 659 operates as follows. As the slide rack 658 is driven by the motor 662, the parallel pins 673*a*, 673*b*, 673*c*, and 673*d* move along the cam grooves 658*a*, 658*b*, 658*c*, and 658*d* in which V grooves are formed.

As the parallel pins 673*a*, 673*b*, 673*c*, and 673*d* move, the second blade 659 moves in the Ja direction in FIG. 19. Thus, the second blade 659 moves to be inserted into the punch hole already formed in the sheet P. The second blade 659 is fitted into the second die hole 619 of the second die 605, and removes the burr of the punch hole of the sheet P.

As described above, in the sheet, the punch hole is formed from one surface by the punching operation of the first blade 609, and the burr is removed from the other surface by the movement of the second blade 659. After the burr removal operation by the second blade 659, the sheet P is conveyed in an H direction by the conveyance roller pairs 402 and 404.

Figure 20:
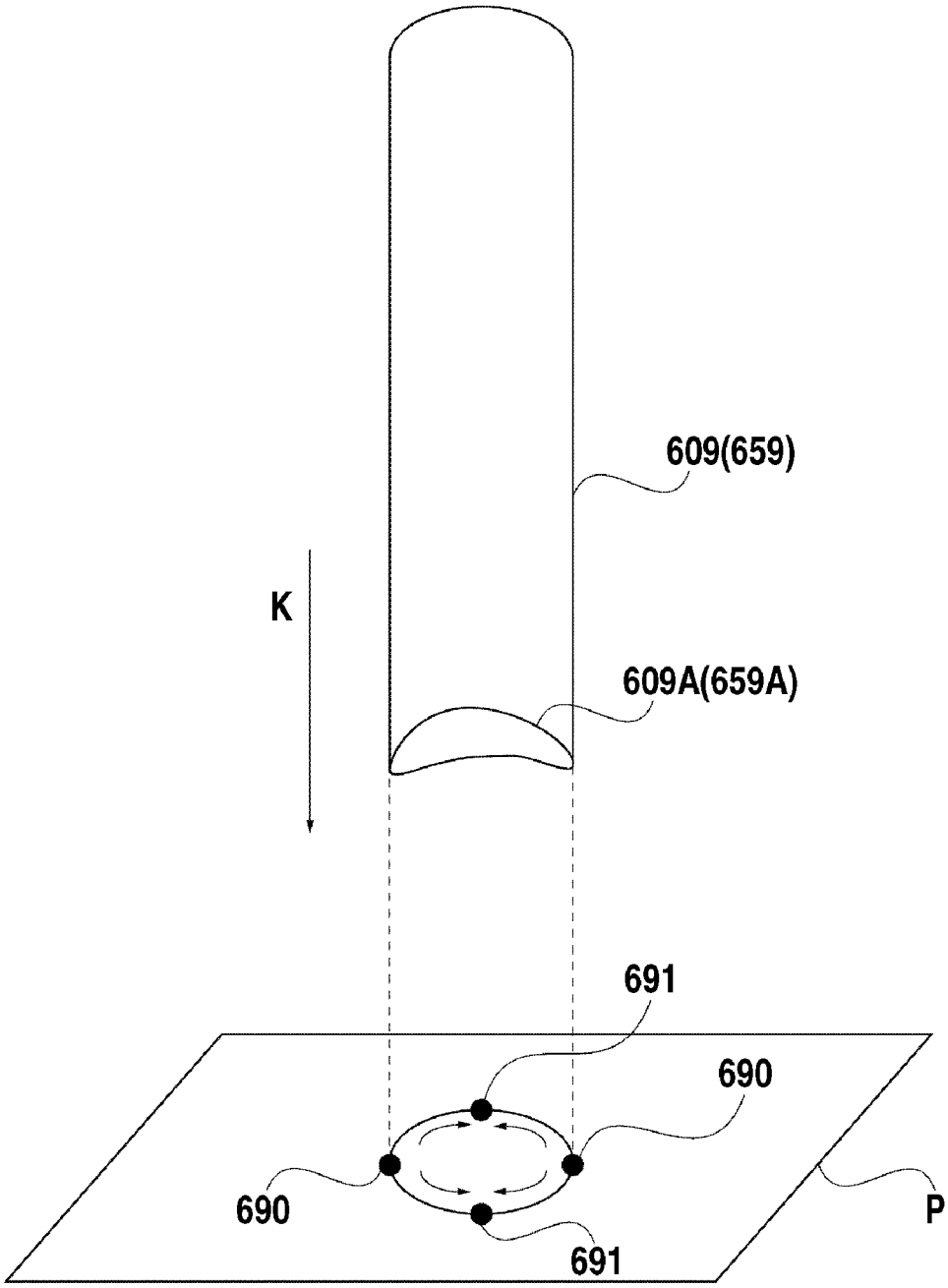
FIG. 20 illustrates a state of punching a sheet by the sheet punching device.

As illustrated in FIG. 20, the first blade 609 and the second blade 659 have concave and convex portions, and have a blade edge shape in which when the blade moves toward the sheet P in a K direction, the punch hole is gradually formed, according to a movement distance of the blade which moves in the die direction, starting from a blade edge contact portion 690 corresponding to the convex portion.

Specifically, a first front end portion 609A with a wave form including a continued concave-convex portion is formed in the front end of the first blade 609, and a second front end portion 659A of a wave form including a continued concave-convex portion is also formed in the front end of the second blade 659.

At the time of punching by the first blade 609, the sheet P is cut, starting from the blade edge contact portion 690 by the convex portion of the first front end portion 609A, toward (in an arrow direction) a last portion 691 cut by the concave portion of the first front end portion 609A. However, the deflection easily occurs around the last portion 691 to be cut. Therefore, the blade edge contact portion 690, which is initially contacted and cut by the convex portion of the punch blade edge, is clearly cut, but the burr is easily generated in the last portion 691 to be cut.

Figure 21:
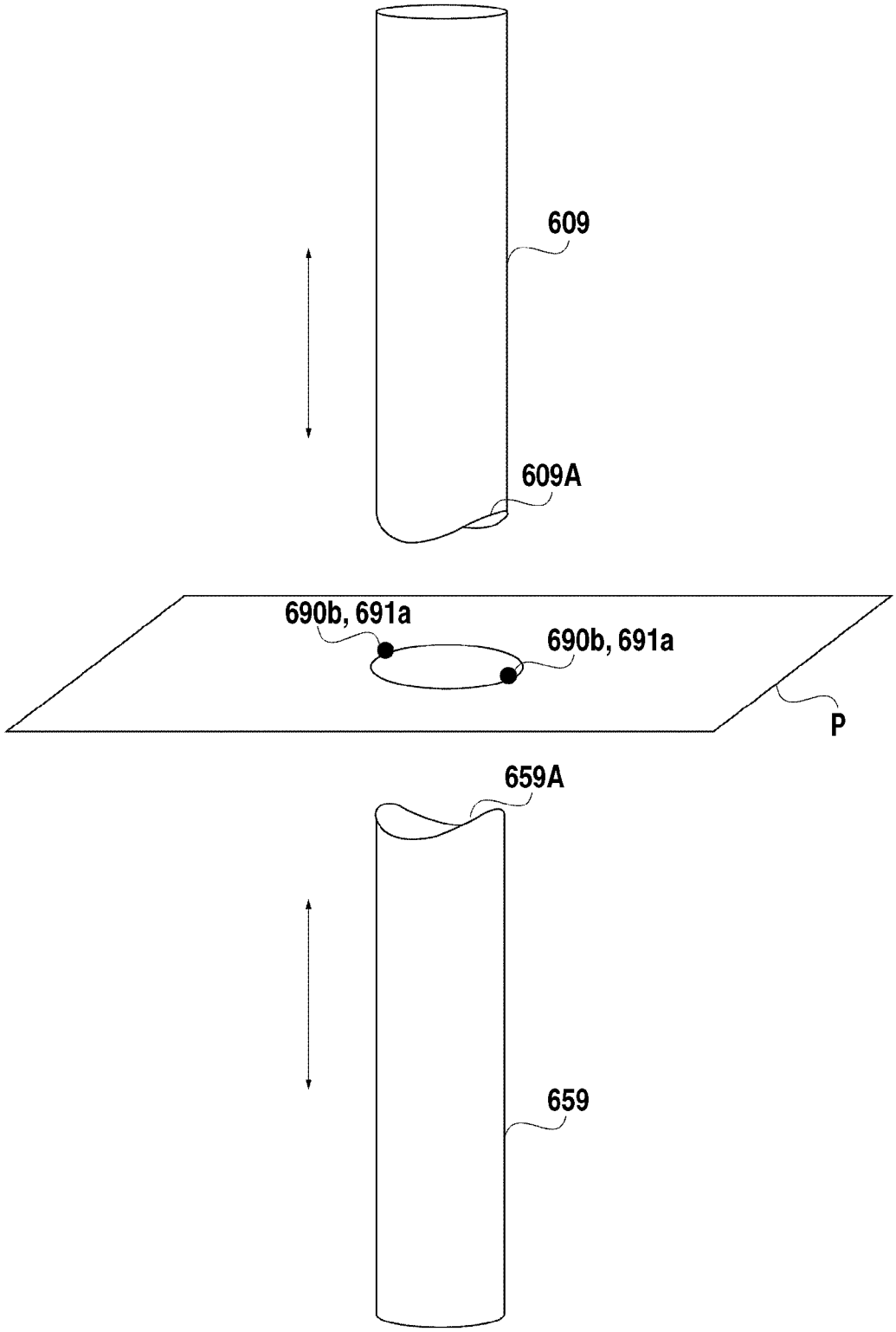
FIG. 21 illustrates a state of punching a sheet through the sheet punching device.

Thus, as illustrated in FIG. 21, the first blade 609 and the second blade 659 are disposed by shifting their phases centering on axes of the punch blades, and the concave portion of the first blade 609 and the convex portion of the second blade 659 can coincide with each other so that a portion 691*a* of the burr generated by the punching operation of the first blade 609 and the blade edge contact point 690*b* of the second blade 659 can coincide with each other.

In FIG. 21, the portion 691*a* of the burr coincides with the blade edge contact point 690*b* of the second blade 659, but even though the portion 691*a* of the burr and a portion of the sheet lastly cut by the second blade 659 are displaced, the similar effect can be obtained.

As described above, even though the burr is generated by punching of the first blade 609, it is possible to remove the burr of the sheet by movement of the second blade 659. Further, even though the blade edge shape is applied to the first front end blade 500 and the stepped blade 501 of the first exemplary embodiment, the similar effect can be obtained.

The rear end of the sheet is abutted against the rear end stopper 621, so that a distance from the sheet rear end to the punched portion becomes constant. The sheet P entering from the arrow H direction in FIG. 17 pushes off the rear end stopper 621, at the front end of the sheet P, in an I direction in FIG. 17 centering on the rotation fulcrum point 624.

When the rear end of the sheet P comes out of the rear end stopper 621, the rear end stopper 621 returns to its original position by a spring (not illustrated) connected to the rear end stopper 621. Thereafter, the sheet P is switched back by the conveyance roller pairs 402 and 424 illustrated in FIG. 4, and abutted against a abutting portion 625 of the rear end stopper 621, so that the punching position of the sheet P from the sheet rear end is determined.

FIG. 12 is a flowchart illustrating an operation of the sheet punching unit 201. An operation of the fourth exemplary embodiment is different from the first exemplary embodiment in an operation of Step S170 of the flow, and the other operations are similar, and thus description thereof will not be repeated. In the fourth exemplary embodiment, the punching operation of the sheet punching device 202 for the sheet is as described above.

The configuration of the sheet punching device 202 has been described focusing on the case in which the first blade 609 and the second blade 659, which are disposed in a horizontal path, punch the hole in the sheet in the nearly vertical direction. However, other than the above configuration, a configuration in which the first blade 609 and the second blade 659 are disposed in a vertical path and punching is performed in the nearly horizontal direction, or a configuration in which the first blade 609 and the second blade 659 are disposed in an inclined path can also have the similar effect to the present invention.

Figure 22:
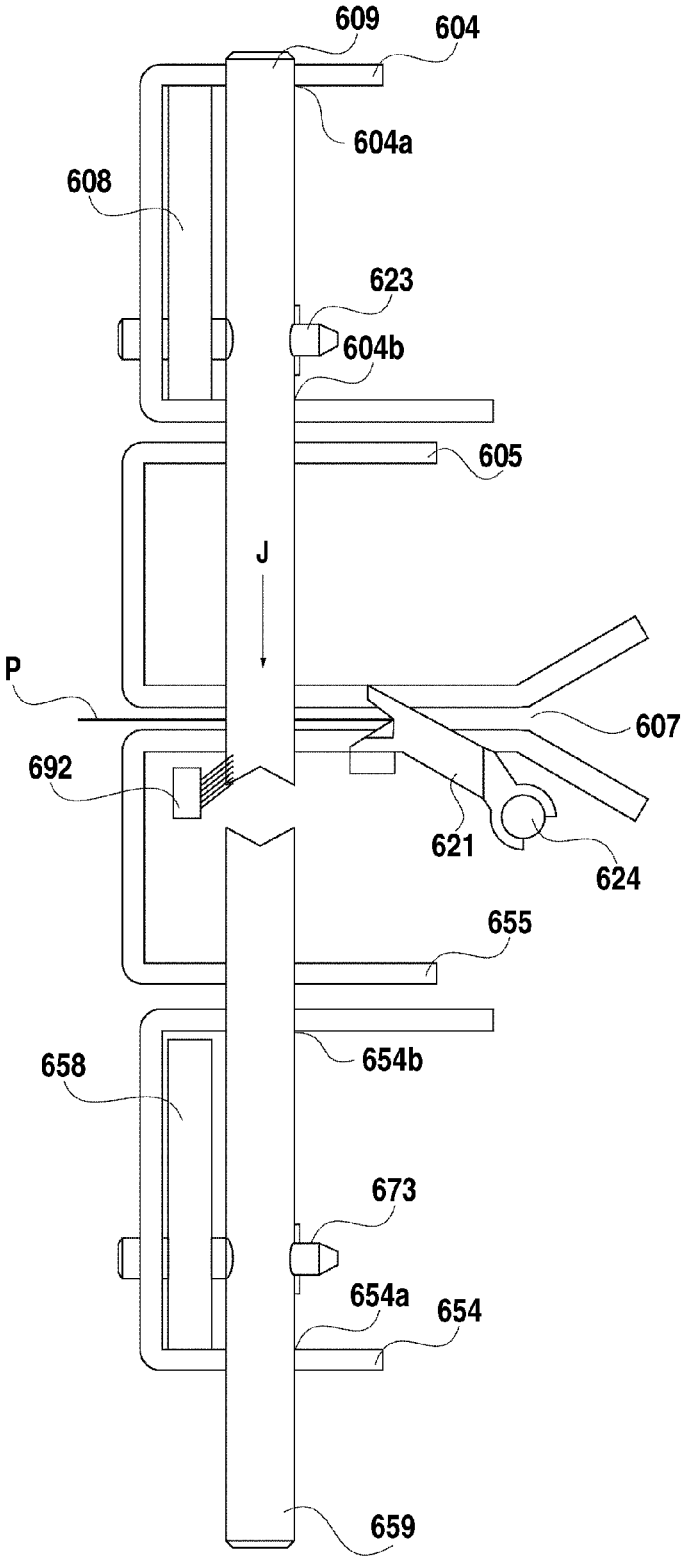
FIG. 22 illustrates a configuration of a chip removing mechanism of a sheet punching device according to a fifth exemplary embodiment.

FIG. 22 is a view illustrating a configuration of a chip removing brush 692 of the sheet punching device 202. A configuration of the sheet punching device 202 according to a fifth exemplary embodiment is almost the same as that illustrated in the fourth exemplary embodiment, and the similar components are denoted by the same reference numerals. The operation is also almost the same as that in the fourth exemplary embodiment, and thus description thereof will not be repeated. A different point is that the chip removing brush 692 is disposed. The chip removing brush 692 is described below in detail.

In the sheet punching device 202 of the fourth exemplary embodiment, a moving direction of the first blade 609 and the second blade 659 is the nearly horizontal direction, and the punch chip box 203 is disposed below the first blade 609 and the second blade 659. Since the punch chip box 203 is disposed as described above, the punch chips generated by punching of the first blade 609 fall into the punch chip box 203.

However, when the moving direction of the first blade 609 and the second blade 659 is the nearly vertical direction, the punch chips generated by punching of the first blade 609 may fall to the second blade 659 directly and be caught on the punch blade edge. Thus, the second blade 659 performs the burr removal operation while the punch chips are attached thereto, and the burr may not be sufficiently removed.

As illustrated in FIG. 22, to prevent the punch chips from falling to the second blade 659, the chip removing brush 692 is disposed around a lowest point at the time of the punching operation of the first blade 609. The chip removing brush 692 is configured with an elastic body, and can remove the punch chips of the punch front whenever the first blade 609 and the second blade 659 move. The removed punch chips fall into and are accumulated in the punch chip box 203 illustrated in FIG. 4.

As the punch chip removing mechanism to remove the punch chips attached to the punch blade edge, in the fifth exemplary embodiment, the chip removing brush 692 is disposed at the lowest point at the time of the punching operation of the first blade 609. However, as an alternative means, air may be injected onto the punch front to remove the punch chips. Further, if any means, which is capable of removing the chips attached to the punch blade edge, is disposed, it is possible to obtain the similar effect as that of the present invention.

Figure 23:
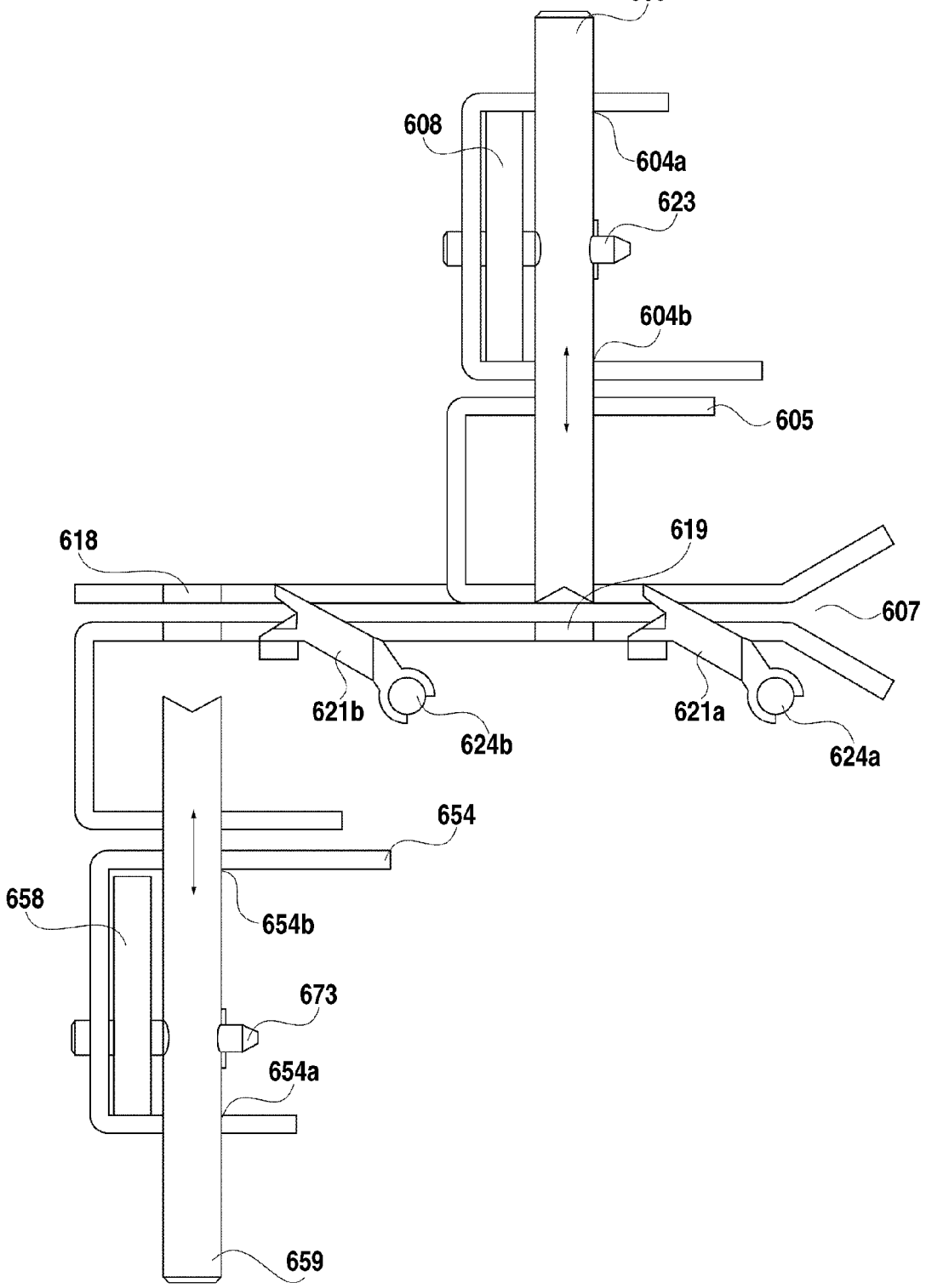
FIG. 23 illustrates an operation of a sheet punching device according to a sixth exemplary embodiment.
Figure 24:
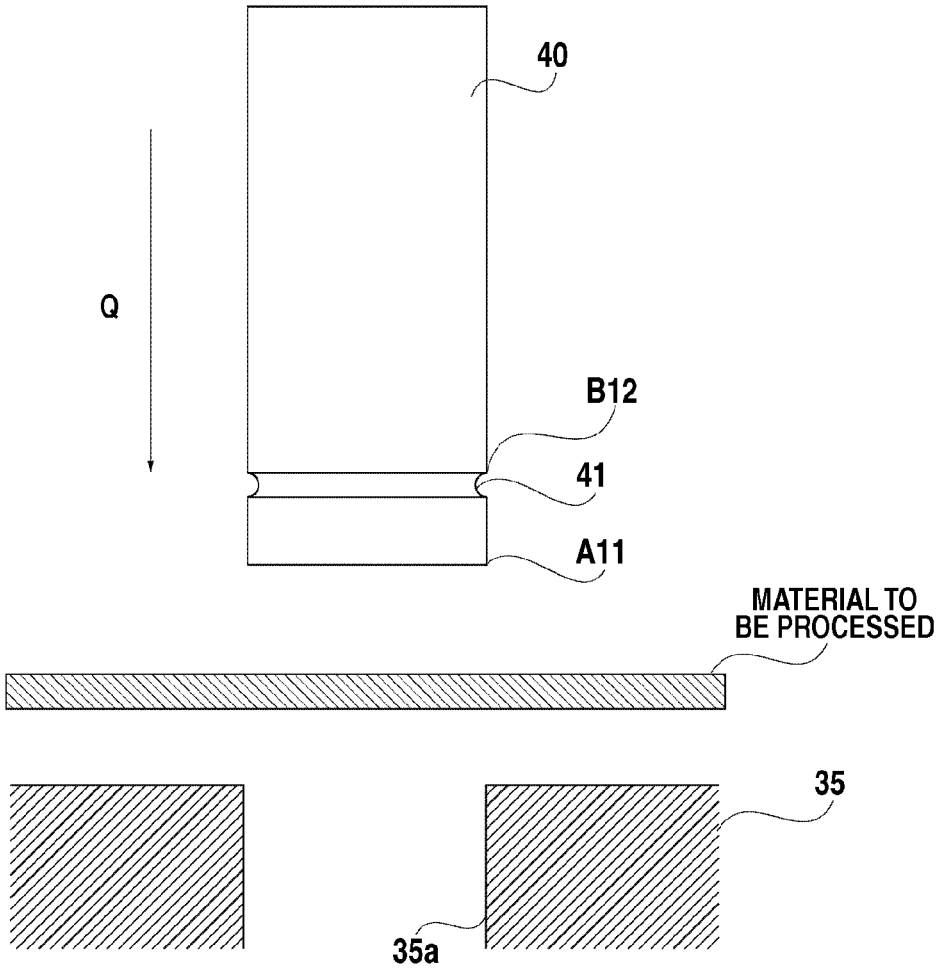
FIG. 24 illustrates an example of a conventional art.

FIG. 23 is a view illustrating a configuration of a sixth exemplary embodiment. Components, which are described in the fourth or fifth exemplary embodiment, are denoted by the same references, and descriptions thereof will not be repeated. In the fourth exemplary embodiment, the second blade 659 is disposed coaxially with the first blade 609 at a position facing the first blade 609.

The sixth exemplary embodiment is almost the same as the first and second exemplary embodiments except that the second blade 659 is not disposed coaxially with the first blade 609, two kinds of rear end stoppers 621 are present, and an operation of abutting the sheet rear end against the rear end stopper 621 is performed twice. Therefore, description of the portions whose operations have been already described therein will not be repeated.

For the punching operation in the sixth exemplary embodiment, in the same manner as in the fourth exemplary embodiment, the sheet is abutted against a first rear end stopper 621*a*, and punching is performed by the first blade 609. Thereafter, the sheet is moved in a punch position direction of the second blade 659, and then the conveyance roller pairs 402 and 424 are reversely rotated to abut the sheet rear end against a second rear end stopper 621*b*. The second blade 659 is moved in a reverse direction to remove the burr.

With the configuration described above, even though the moving direction of the punch blade is the nearly vertical direction, the punch chips generated by the punching operation of the first blade 609 do not fall to the punch blade edge of the second blade 659. Further, it is possible to stably remove the burr by movement of the second blade 659 without installing the punch chip removing mechanism.

In the configurations of the fourth to sixth exemplary embodiments, the first blade 609 disposed in an upper position moves downward to punch the holes, and thereafter the second blade 659 moves upward in the reverse direction to remove the burr. However, the moving order may be changed. Even though the second blade 659 first moves upward to punch the holes, and then the first blade 609 moves downward in the reverse direction to remove the burr, the similar effect can be obtained.

Further, in the configuration illustrated in FIG. 4, the moving direction of the first blade 609 and the second blade 659 is the nearly horizontal direction, but even though the moving direction is the nearly vertical direction or a different direction, the similar effect can be obtained.

Further, in the sixth exemplary embodiment, a configuration, in which the first blade 609 and the second blade 659 are not coaxially disposed, is provided. After the punching operation of the first blade 609, the sheet is moved up to the punching position of the second blade 659, and the burr is removed in the reverse direction. However, after the punching operation by the first blade 609, the sheet may not be moved. In this case, the first blade 609 moves back from the punching position, and the second blade 659 then moves to the sheet punching position. The burr of the sheet is removed from the reverse direction by the second blade 659.

According to the exemplary embodiments, a first blade is fitted into a sheet from a first surface of the sheet to form a punch hole in the sheet, and a second blade can be inserted into the punch hole formed by the first blade from a second surface of the sheet. Accordingly, when punching a sheet having low rigidity such as thin paper or when punching in the high-humidity environment, it may be possible to remove or minimize the burr generated in the sheet when forming the punch hole. While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-152622 filed Jun. 26, 2009, which is hereby incorporated by reference herein in its entirety.

What is claimed is:

1. A sheet punching device comprising:

a first blade which moves in a first direction and a second direction opposite to the first direction;

a first die into which the first blade moved in the first direction is fitted to form a punch hole in the sheet;

a second blade which moves together with the first blade in the first direction and the second direction;

a second die into which the second blade moved in the second direction is fitted; and a pressing member configured to move the sheet in which the punch hole is formed to press to the second die after the first blade is fitted into the first die to form the punch hole in the sheet, wherein the second blade is inserted into the punch hole formed by the first blade and fitted into the second die by a movement in the second direction.

2. The sheet punching device according to claim 1, wherein the first blade and the second blade are separately formed from each other and disposed to face each other.

3. The sheet punching device according to claim 1, further comprising:

a chip removing mechanism configured to remove punch chips generated by the first blade.

4. An image forming apparatus comprising:

an image forming unit configured to form an image on a sheet; and a sheet punching device according to claim 1 which forms a punch hole in the sheet on which the image is formed.

5. A sheet punching device comprising:

a first blade which moves in a first direction and a second direction opposite to the first direction;

a first die into which the first blade moved in the first direction is fitted to form a punch hole in the sheet;

a second blade which moves together with the first blade in the first direction and the second direction; and a second die into which the second blade moved in the second direction is fitted, wherein the second blade is inserted into the punch hole formed by the first blade and fitted into the second die by a movement in the second direction, wherein the first blade has concave and convex portions and gradually forms the punch hole in the sheet, starting from the convex portion, according to a moving distance in the first direction, wherein the second blade has concave and convex portions and gradually forms the punch hole in the sheet, starting from the convex portion, according to a moving distance, in the second direction, and wherein the first blade and the second blade are disposed so that a position of the concave portion of the first blade in which the first blade lastly cuts the sheet coincides with a position of the convex portion of the second blade in which the second blade initially cuts the sheet.

6. The sheet punching device according to claim 5, further comprising:

a chip removing mechanism configured to remove punch chips generated by the second blade.

7. An image forming apparatus comprising:

an image forming unit configured to form an image on a sheet; and a sheet punching device according to claim 5 which forms a punch hole in the sheet on which the image is formed.

8. The sheet punching device according to claim 5, wherein the first blade and the second blade are separately formed from each other and disposed to face each other.

9. A sheet punching device comprising:

a first blade which moves in a first direction and a second direction opposite to the first direction;

a first die into which the first blade moved in the first direction is fitted to form a punch hole in the sheet;

a first die hole formed in the first die and through which the first blade is fitted into the first die;

a second blade which moves together with the first blade in the first direction and the second direction;

a second die into which the second blade moved in the second direction is fitted;

a second die hole formed in the second die and through which the second blade is fitted into the second die; and a pressing member configured to move the sheet, in which the punch hole is formed, to press to the second die after the first blade is fitted into the first die to form the punch hole in the sheet, wherein the second blade is inserted into the punch hole formed by the first blade and fitted into the second die by a movement in the second direction, and wherein the first blade moves by being guided by the second die hole, and the second blade moves by being guided by the first die hole.

10. The sheet punching device according to claim 9, wherein the first blade and the second blade are separately formed from each other, and disposed to face each other.

11. The sheet punching device according to claim 9, further comprising:

a chip removing mechanism configured to remove punch chips generated by the first blade.

12. An image forming apparatus comprising:

an image forming unit configured to form an image on a sheet; and a sheet punching device according to claim 9 which forms a punch hole in the sheet on which the image is formed.

13. A sheet punching device comprising:

a first blade which moves in a first direction and a second direction opposite to the first direction;

a first die into which the first blade moved in the first direction is fitted to form a punch hole in the sheet;

a first die hole formed in the first die and through which the first blade is fitted into the first die;

a second blade which moves together with the first blade in the first direction and the second direction;

a second die into which the second blade moved in the second direction is fitted; and a second die hole formed in the second die and through which the second blade is fitted into the second die, wherein the second blade is inserted into the punch hole formed by the first blade and fitted into the second die by a movement in the second direction, wherein the first blade moves by being guided by the second die hole, and the second blade moves by being guided by the first die hole, wherein the first blade has concave and convex portions, and gradually forms the punch hole in the sheet, starting from the convex portion, according to a moving distance in the first direction, wherein the second blade has concave and convex portions, and gradually forms the punch hole in the sheet, starting from the convex portion, according to a moving distance in the second direction, and wherein the first blade and the second blade are disposed so that a position of the concave portion of the first blade in which the first blade lastly cuts the sheet coincides with a position of the convex portion of the second blade in which the second blade initially cuts the sheet.

14. The sheet punching device according to claim 13, further comprising:

a chip removing mechanism configured to remove punch chips generated by the second blade.

15. An image forming apparatus comprising:

an image forming unit configured to form an image on a sheet; and the sheet punching device according to claim 13, which forms a punch hole in the sheet on which the image is formed.

16. The sheet punching device according to claim 13, wherein the first blade and the second blade are separately formed from each other, and disposed to face each other.

* * * * *